US005555984A

United States Patent [19]

Sommer, Jr. et al.

[11] Patent Number: 5,555,984

[45] Date of Patent: Sep. 17, 1996

[54] AUTOMATED GLASS AND PLASTIC REFUSE SORTER

[75] Inventors: Edward J. Sommer, Jr., Nashville; Michael A. Kittel, Unionville; Ronald A. Quarles, Nolensville, all of Tenn.

[73] Assignee: National Recovery Technologies, Inc., Nashville, Tenn.

[21] Appl. No.: 96,178

[22] Filed: Jul. 23, 1993

[51] Int. Cl.[6] ..... B07C 5/342

[52] U.S. Cl. ..... 209/580; 209/581; 209/587; 209/939; 250/223 R; 250/226

[58] Field of Search ..... 209/564, 576, 209/577, 580–582, 587, 639, 644, 911, 939, 588, 938; 250/223 R, 226; 356/421, 425, 445, 448; 359/509

[56] References Cited

U.S. PATENT DOCUMENTS

| | | | |
|---|---|---|---|
| 3,650,396 | 3/1972 | Gillespie et al. | 209/3 |
| 3,782,544 | 1/1974 | Perkins, III | 209/587 X |
| 4,057,146 | 11/1977 | Castaneda et al. | 359/509 X |
| 4,076,979 | 2/1978 | Walter et al. | 250/226 |
| 4,077,871 | 3/1978 | Kumar et al. | 209/4 |
| 4,252,240 | 2/1981 | Satake | 209/580 |
| 4,352,430 | 10/1982 | Maier et al. | 209/581 X |
| 4,513,868 | 4/1985 | Culling et al. | 209/581 |
| 4,630,736 | 12/1986 | Maughan et al. | 209/587 |
| 4,657,144 | 4/1987 | Martin et al. | 209/581 X |
| 4,699,273 | 10/1987 | Suggi-Liverani et al. | 209/580 |
| 4,909,930 | 3/1990 | Cole | 209/564 |
| 5,101,101 | 3/1992 | Sawamura | 250/223 R |
| 5,135,114 | 8/1992 | Satake et al. | 209/588 X |
| 5,215,772 | 6/1993 | Roth | 209/587 X |
| 5,241,171 | 8/1993 | Fraenkel | 250/223 R |

FOREIGN PATENT DOCUMENTS

| | | | |
|---|---|---|---|
| 642283 | 8/1950 | United Kingdom | 209/581 |

*Primary Examiner*—William E. Terrell
*Assistant Examiner*—Tuan Nguyen
*Attorney, Agent, or Firm*—Foley & Lardner

[57] ABSTRACT

An automated sorter includes a feed slide on which containers or refuse may be fed. The feed slide includes a separation region on which a several objects may be located. A light source directs light on the objects in the separation region. An ejector, including several ejector units, is positioned downward of the separation region. A scanner scans the separation region, determines when an object should be ejected, and controls the ejector units to eject the selected objects. Thus, the selected objects are ejected into a first fraction, and the non-selected objects are left in a second fraction. A fraction thus obtained can be sorted, to separate the containers or refuse into further fractions.

10 Claims, 23 Drawing Sheets

AUTOMATED GLASS AND PLASTIC REFUSE SORTER

FEDERALLY SPONSORED RESEARCH AND DEVELOPMENT

The U.S. Government has a paid-up license in this invention and the right in limited circumstances to require the patent owner to license others on reasonable terms as provided for by the terms of Contract No. 68D20115 awarded by the Environmental Protection Agency.

BACKGROUND OF THE INVENTION

1. Field of the Invention

The invention relates to an automated glass and plastic refuse sorter, and, more particularly, to an automated sorter for use in sorting post-consumer glass and plastic containers and refuse by color.

Landfills, into which waste material is deposited, are a limited resource. The material placed into landfills contains large amounts of recyclable materials, including glass and plastic refuse such as post-consumer glass and plastic containers. Recovery of these materials can extend the life of landfills.

Materials Recovery Facilities (MRF) provide for the collection, sorting and marketing of discarded recyclable materials. For MRF to be cost effective, it must recover high percentages of recyclable materials and prepare them into a marketable condition. Simply collecting recyclable materials is only part of the recycling effort.

A critical part of the recycling process is the preparation of the materials into a marketable condition. Due to special requirements for market use, glass and plastic refuse is particularly prone to non-marketability problems. In order for glass refuse to be marketable to glass container manufacturers, it must be relatively free of contaminants and sorted by color. In order for plastic refuse to be marketable at its highest value, it must be separated by both color and by polymer group.

2. Discussion of the Related Art

The color sorting of whole post-consumer containers is presently accomplished by hand-sorting, either by the consumer prior to collection, or at the MRF after collection. Consumer sorting is undesirable, as it has high costs incurred by the separate collection and transportation, and moreover, it very likely does not maximize the overall amount recovered. A special problem presented by glass is that it may be broken in collection, transportation or processing. Such glass cannot be hand sorted due to excessive labor requirements and obvious safety risks. Thus, broken glass primarily remains unsorted, and hence is not recycled due to low marketability of mixed color glass.

A variety of conventional sorting apparatuses are known, including glass sorting apparatuses. For example, U.S. Pat. No. 3,650,396, to Gillespie et al., discloses an apparatus for sorting refuse into its components for recycle. A glass sorting section feeds glass particles one by one through a housing, where the particles are sorted into clear and colored particles. One disadvantage with such a singulation conventional sorting apparatus is that the particles must be fed in one by one. Another disadvantage is that the particles can not be extremely disparate in size.

Another singulation particle sorter is disclosed in U.S. Pat. No. 4,252,240, to Satake. A shooter feeds pieces one at a time, and an air ejector is actuated by a photosensitive detector to discriminate unacceptable particles. U.S. Pat. No. 4,513,868, to Culling, et al., discloses yet another singulation sorter. It also discloses a photoelectric means for comparing the average transmission or emission of light by a background behind the objects. Other traditional singulation sorting machines are disclosed in U.S. Pat. Nos. 4,630,736, and 4,699,273.

Traditional devices and methods for sorting glass by color are known. For example, U.S. Pat. No. 4,077,871, to Kumar et al., discloses a process for color sorting of particulate glass by raising the temperature of the glass and contacting the differentially heated glass with an organic thermoplastic material which melts in a narrow temperature range. The glass particles can then be sorted by various means, including froth flotation or adhesion. U.S. Pat. No. 4,076,979, to Walter et al., discloses a bottle color identification apparatus, which can be used to sort returnable bottles with the same size and shape into their respective colors.

Other traditional sorters are known for use with other objects. For example, U.S. Pat. No. 3,782,544, to Perkins, III, discloses a singulation sorter for sorting tobacco leaves according to color and brightness by comparison to a background color. U.S. Pat. No. 4,909,930, to Cole, discloses a sorter for separating foreign objects from a stream of material. Overlapping detection zones are utilized to actuate one or a group of nozzles to reject, for example, a piece of paper. Unfortunately, these traditional sorters are not useful for sorting discarded post-consumer bottles and cullet.

SUMMARY OF THE INVENTION

It is therefore an object of the present invention to provide an automated glass and plastic refuse sorter which can recover high percentages of recyclable post-consumer glass and plastic refuse, including glass bottles and cullet, and sort it into a marketable condition.

It is another object of the present invention to provide for mass sorting of a feedstream of materials rather than singulation.

It is a further object of the present invention to provide a sorter which ejects materials of selected colors out of the feedstream of materials without ejecting surrounding materials.

It is yet another object of the present invention to provide improved accuracy in sorting.

It is a feature of the present invention that a mass of objects are fed, scanned and sorted.

It is a feature of the present invention that the scanner is protected from other refuse, liquid and dirt in the stream of glass or plastic materials to be sorted, and thus is less likely to need frequent cleaning.

It is a feature of the present invention that the light source is protected from other refuse, liquid and dirt in the stream of glass or plastic materials to be sorted, and thus is less likely to need frequent cleaning.

It is another feature of the present invention that video imaging is used to determine the relevant appearance of an object in the stream.

It is an advantage of the present invention that it can be used at high speeds and with large volumes of waste.

It is another advantage of the present invention that the scanner is less obscured by refuse or dirt in the stream of materials.

The automated sorter of the invention includes a feed slide on which a plurality of containers or refuse may be fed, including a separation region on which a plurality of objects may be located. A light source, cooperating with the feed slide, is positioned to direct light on the separation region. An ejector including a plurality of ejector units, is positioned downward of the separation region. A scanner, cooperating with the feed slide and light source, positioned to scan the separation region, determines when an object should be ejected, and controls the ejector units.

In accordance with another aspect of the invention, refuse objects having different color values are sorted. A range corresponding to a color value of objects to be ejected is specified. A plurality of objects is passed over a separation region. The objects are scanned with a scanner. A color value of each object is determined. At least some of the objects, which have the color value within the specified range, are selected for ejection. The selected objects are ejected into a first fraction by at least one of a plurality ejector units. Thereby, the non-selected objects are left in a second fraction.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The present invention will be described below with reference to the accompanying drawings, wherein.

DETAILED DESCRIPTION OF THE PREFERRED EMBODIMENTS

A sorter is used for sorting objects, such as glass bottles, glass cullet, or plastic bottles. A feedstream of objects is fed into the sorter. Since the feedstream may be obtained from refuse in general, the feedstream may also include dirt, liquids and other junk.

Figure 1:
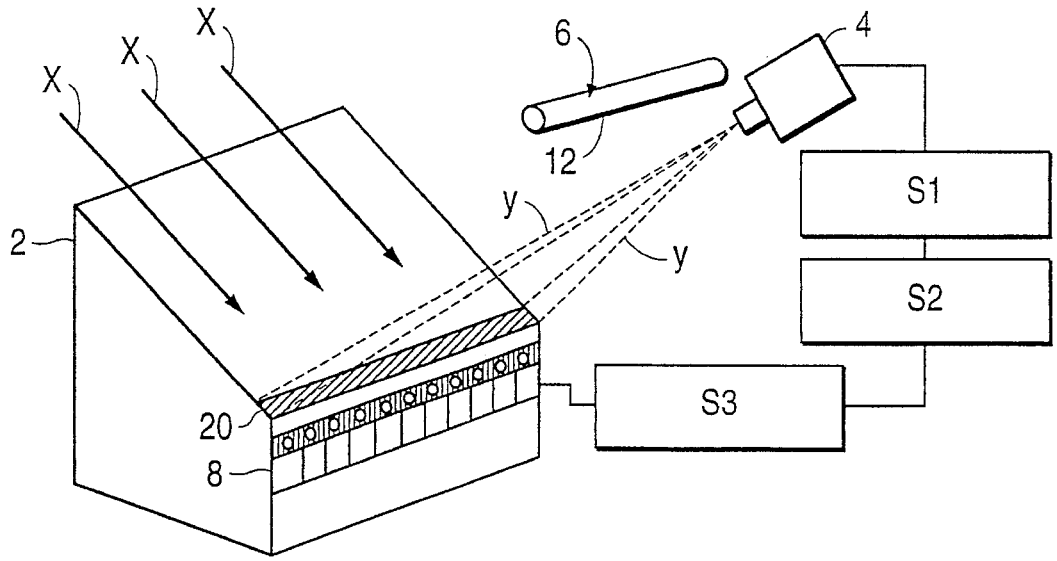
FIG. 1 is a perspective view of a first exemplary embodiment of the invention.

The sorter according to the invention, one exemplary embodiment of which is illustrated in FIG. 1, includes a feed slide 2, a scanner 4, with associated optical filter mechanism 4*a*, a light source 6, and an ejector 8. The feed slide 2 preferably passes objects in a downward direction x, to be sorted in a feedstream passed before the scanner 4 and filter 4*a*. The scanner 4 detects and determines objects to be sorted, and activates the ejector 8, in order to sort the selected objects from the feedstream. The light source 6 provides predictable light on the objects, which improves the accuracy of the scanner 4. The optical filter 4*a* is changeable and may be used to enhance certain colors to improve scanner color detection accuracy.

The light source 6 is used in conjunction with the scanner 4 to determine the color and/or type of the glass or plastic refuse on the feed slide 2. The light source 6 may be either an upper light source 12 located above the feed slide 2 (illustrated in FIG. 1), or a lower light source 32 located below the feed slide 2 (illustrated in FIGS. 2 and 3), and thus either provide a light path y which reflects light off of the objects or shines light through the objects, respectively.

The upper light source 12, illustrated in FIG. 1, located above the feed slide 2 is believed to provide light reflected off of objects in the feed stream so that the scanner 4 senses the color of the objects from the reflected light. The upper light source 12 is preferably located adjacent to the scanner 4. The upper light source 12 is effective when used with opaque glass and plastic refuse, and is also effective when used with transparent glass and plastic refuse.

Figure 2A:
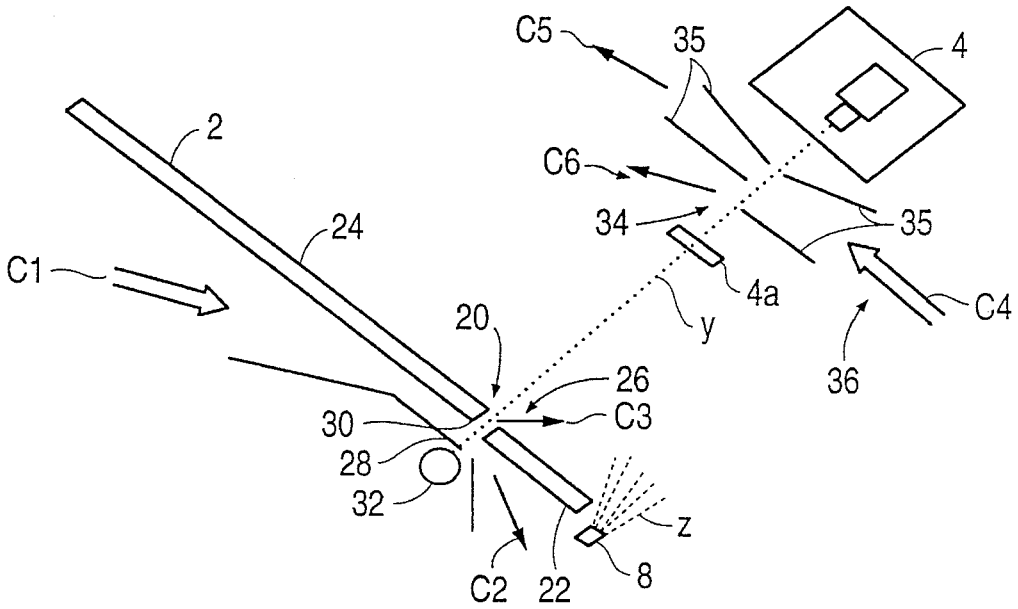
FIGS. 2A–2B are diagrams of a second exemplary embodiment of the invention.
Figure 2B:
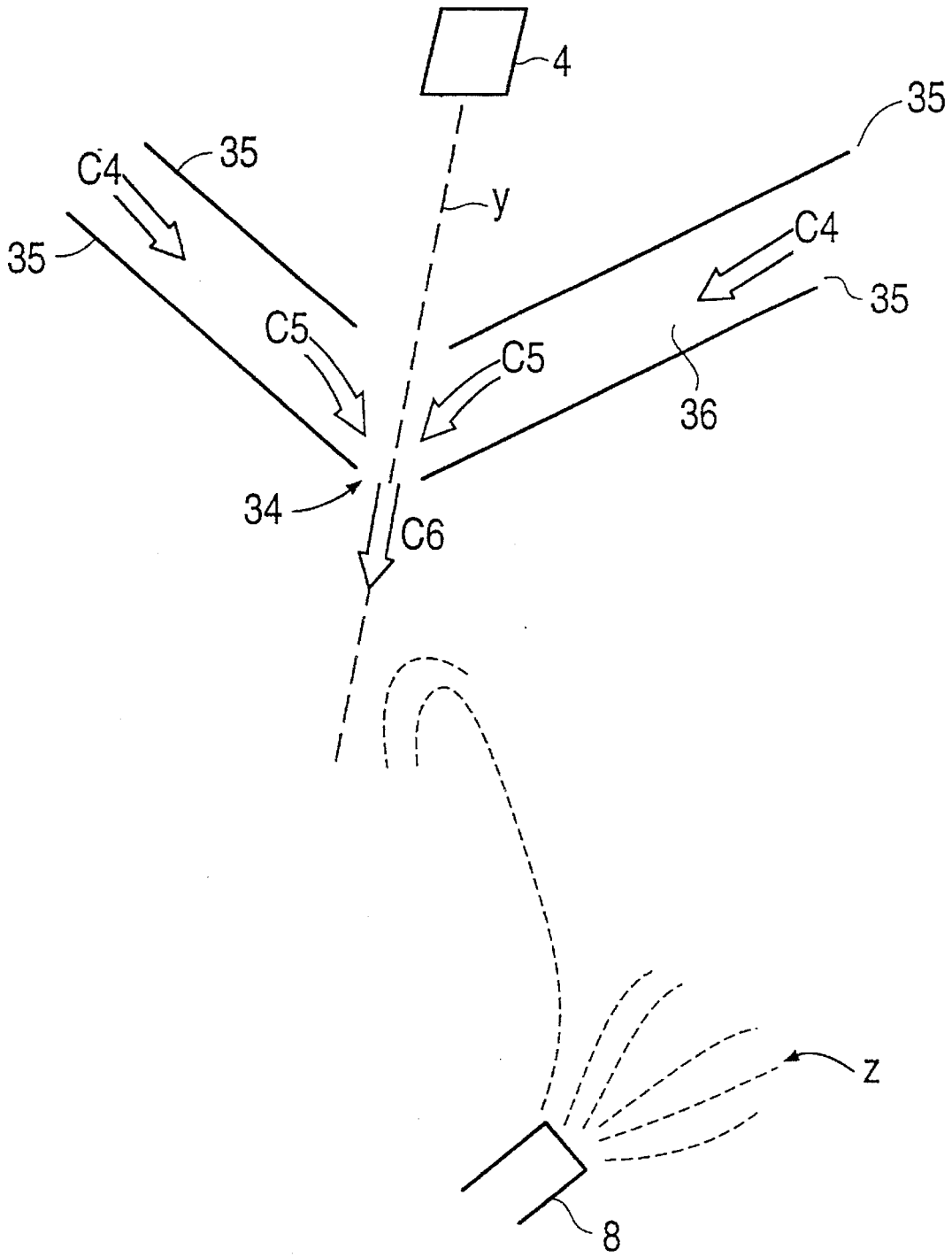
Figure 3:
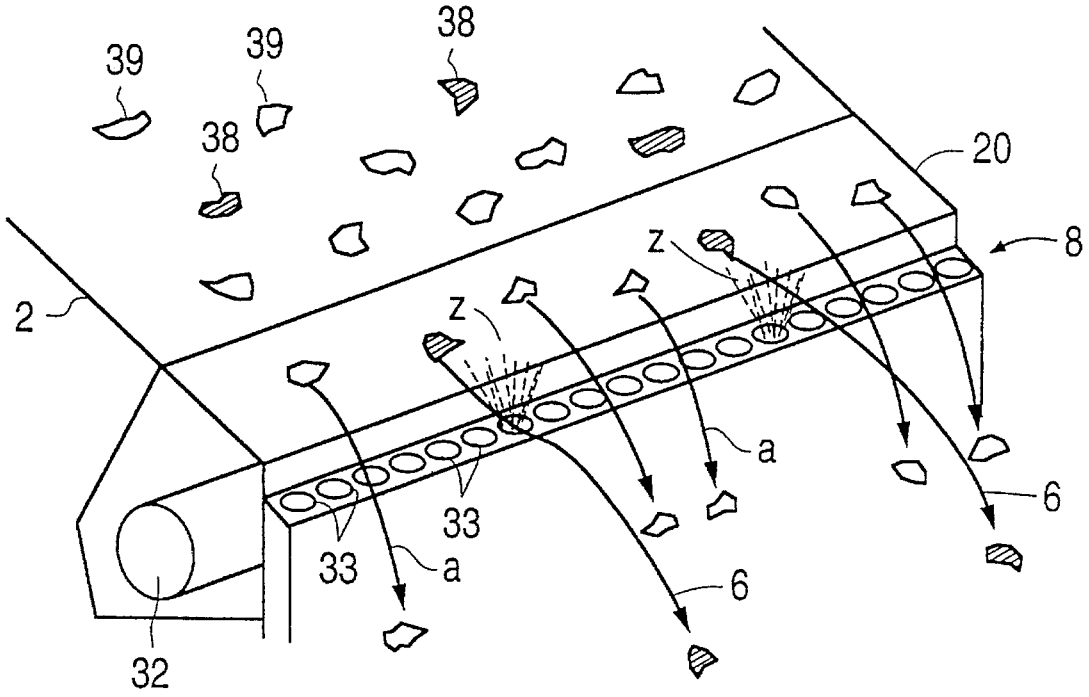
FIG. 3 is a perspective view of an ejector of the second exemplary embodiment of the invention.

Nevertheless, the inventors' research suggests that the lower light source 32, illustrated in FIGS. 2 and 3, is preferred for sorting transparent or translucent objects such as glass, polyethylene terephthalate (PET) plastics, and natural high density polyethylene (HDPE) plastics. This is believed to be because the passage of the light through the transparent or translucent object more vividly displays its color. Alternatively, both an upper and lower light sources 12, 32 may be used at the same time.

The light source 6 should provide a non-varying light output, so as to permit accurate color and transparency determinations. Studies have been conducted on the variability of light from fluorescent light strips. AC current causes a varying light output, with negative results on the accuracy of the color and transparency determinations. Therefore, DC current, or AC current at frequencies sufficiently higher than the scan rate to avoid aliasing, is preferably used to drive the light source.

Figure 11:
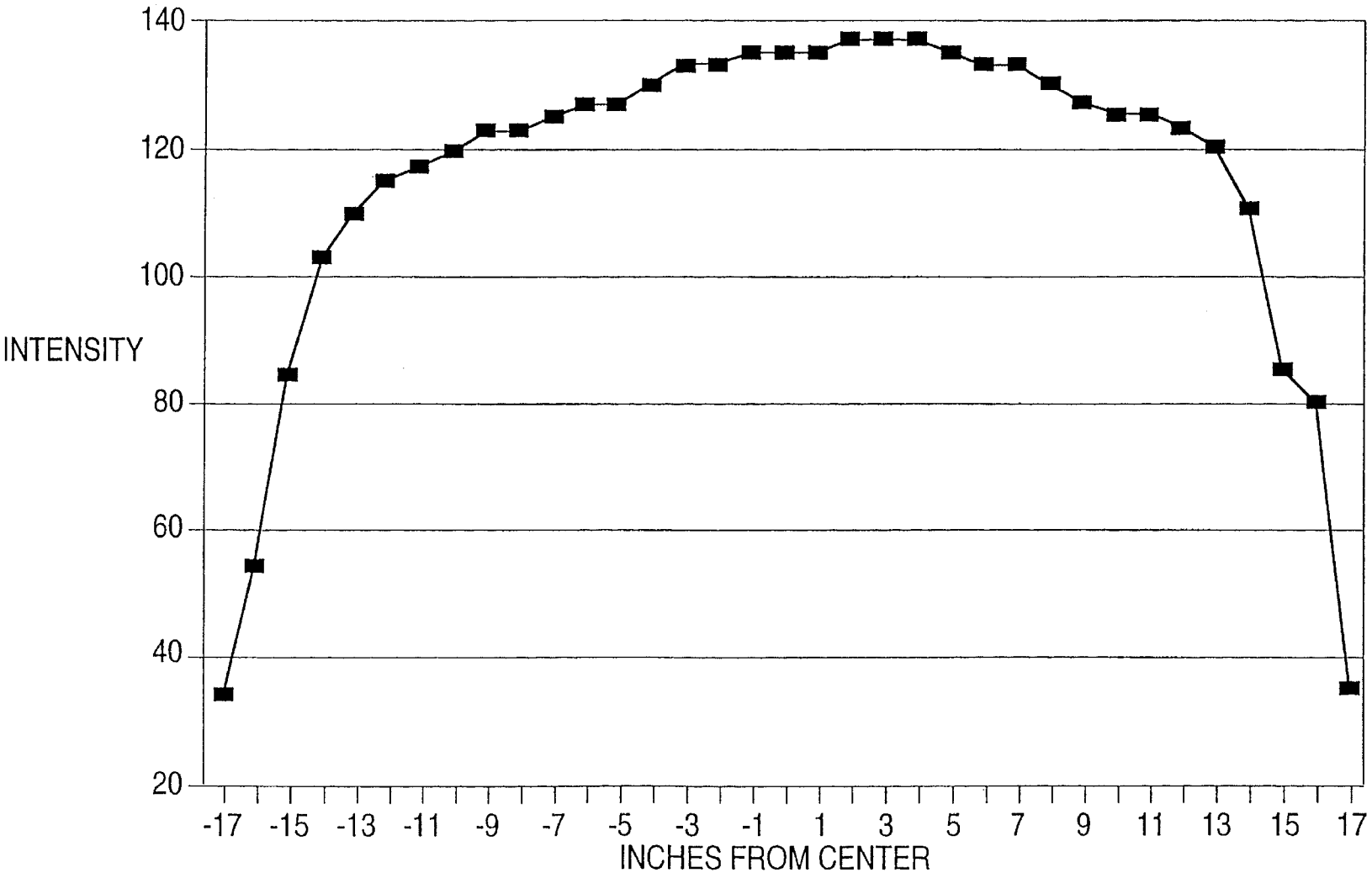
FIG. 11 shows the intensity along a fluorescent 36 inch light bulb taken with a scanner at a distance of 45 inches.

In order to keep the light output at a constant rate, the light source 6 is preferably a fluorescent strip that is driven by a circuit which regulates the light to keep it at the constant rate. One such commercially available circuit is made by Mercron, Inc., of Dallas, Tex. Also, use of the light source 32 is preferably limited to the most constant central regions such as 12 inches either side of center of a 36 inch fluorescent strip as shown in FIG. 11.

The feed slide 2 includes a separation region, in which a plurality of objects may be simultaneously presented to the scanner 4 to be scanned, after which selected objects may be separated from the feedstream. In order to use the lower light source 32, the feed slide 2 includes a slit 20, illustrated in FIG. 2, through which the light from the lower light source 32 shines through the objects. A glass or other transparent surface can be used in place of slit 20. However, the inventors have found that such transparent surfaces require frequent cleaning due to dirt and liquids fouling the surfaces and thus have determined that an air path, such as provided by slit 20 reduces the need for such frequent cleaning.

Dirt and junk in the feedstream may bridge the slit 20. Moreover, edges of the objects may catch in the slit 20. Thus a portion of the light path y may be obscured. To avoid bridging of dirt and junk or catching of edges in the slit 20, the feed slide 2 preferably includes a recessed lower portion 22 downward of the slit 20. The recessed lower portion 22 may advantageously be located one-half to one inch lower than a slide upper portion 24. Additionally, a slit air flow 26 is preferably included by forced air cl forcing an air flow c3 from under the feed slide 2 out of the slit 20, which helps to blow junk and objects away from the slit 20.

Another problem presented by the slit 20 is that an object or junk may pass through the slit, necessitating cleaning of the light source 32. To alleviate this problem, in the preferred embodiment of the invention, there are two slits 28, 30, including a strip slit 28 near the light source 32, and a slide slit 30 in the slide 2. Thus, for an object or junk to pass through both slits, its motion would have to be aligned with the two slits 28, 30 and travel along path y. Moreover, the slit air flow 26 directs briskly flowing air c2, c3 between the two slits 28, 30, and out of slit 30 to deflect such an object or junk which attempts to pass through the slits 28, 30. This reduces the probability of such an occurrence.

The scanner 4 may be a charged coupled device (CCD) camera. An appropriate CCD camera is commercially available from Dalsa, Inc., Waterloo, of Ontario, Canada. The camera may be a gray scale camera or a color RGB camera. Use of filters 4*a* on the camera can enhance some colors.

Since the feedstream includes dirt, junk and liquids, and moreover since the ejector 8 lofts dirt, junk and liquids z, one problem is to keep the light path y between the light source 6 and the scanner 4 as clean as possible during operation, so as to minimize the need for cleaning. The inventors determined that the cleanest light path y is through free air. Consequently, the scanner 4 preferably minimizes use of glass and other parts in the light path, and uses open air paths instead.

Similarly, the component of the scanner 4 which receives the light path must also be kept clean. As illustrated in FIG. 2A and alternatively in FIG. 2B, the scanner 4 preferably utilizes a scanner slit 34 with air curtain 36. The scanner slit 34 may be formed by a pair of bracketing members 35. To help with alignment problems, the bracketing members 35 should be adjustable so as to bracket the light path y as tightly as desired. One of the bracketing members 35 may be recessed with respect to the other bracketing member 35. Preferably, two pairs of bracketing members are provided. Additionally, forced air c4 should be provided to create the air curtain 36 so that an air flow c5 is directed between the scanner slits 34 and c6 out of scanner slit 34 to deflect junk, dirt or liquid which may attempt to get through scanner slits 34.

Forced air for the slit 20 and slit 34 can be provided by either filtered forced air or compressed air. The forced air could alternatively be another gas. The compressed air has the advantage of introducing relatively clean air into the area, which will ensure that contaminated air from other areas in the MRF is not passed over the scanner 4 and light source 6 surfaces. The disadvantage of using compressed air is its relatively higher cost, and the problem that it may introduce humidity.

The scanner 4 determines which of the objects in the feedstream are to be ejected. The determination can conveniently be accomplished by control software s1, s2, s3 running on a processor receiving input from the scanner 4, and controlling the ejector 8. The control software preferably includes video pixel locator logic section s1, color detection and recognition logic section s2, and ejector control logic section s3. An appropriate processor is commercially available from vendors such as Intel, Motorola, etc., and is used as an electronics interface between scanner 4 and the ejector 8.

The control software s1, s2, s3 may include a start sequence for initializing the electronics at power up, a foreground task, and interrupt handlers. The interrupt handlers can conveniently perform the color determination and recognition section and ejector control section.

Figure 4:
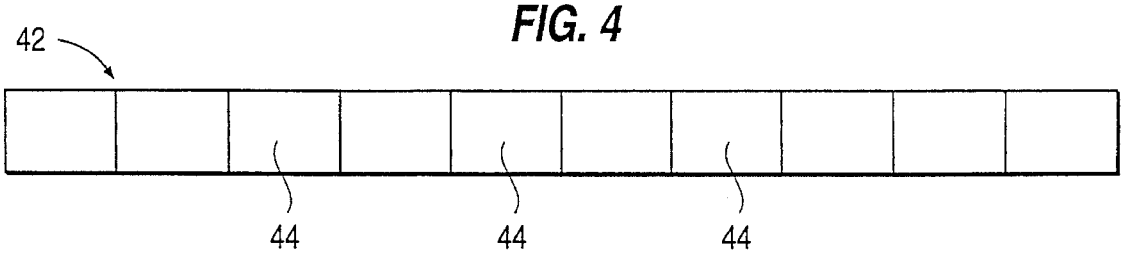
FIG. 4 is a diagram of a scan line.
Figure 5:
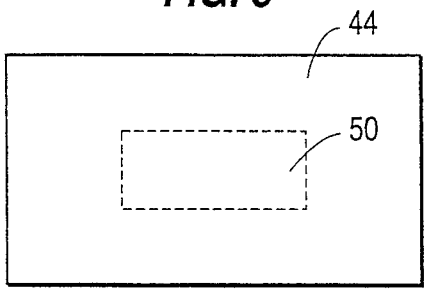
FIG. 5 is a diagram of a scan zone in the scan line.

Reference is made to FIGS. 4 and 5. Preferably, the scanner 4 is a line scan camera which repeatedly scans a linear field of view on the slide 2. As an object moves through the field of view, it is progressively scanned by the camera. An image of the object is built up as it moves through the field of view. One to ten successive scans are preferably used to define an image before beginning again. For high material feed rates the objects tend to move at a rate of about 0.1 inches per scan. Therefore, a scan line 42 of 0.1 to 1 inch wide across the object is observed. This 0.1 to 1 inch wide scan line 42 extends across the width of the slide 2 and crosses all objects feeding down the slide 2 through the field of view. The scan line 42 is logically divided into scan zones 44, illustrated in FIGS. 4 and 5. In one embodiment, the slide 2 has a width of 20 inches and there are ten scan zones 44, therefore each scan zone 44 is two inches wide.

Each scan zone 44 includes a plurality of pixels. An active area 50 within each scan zone 44 is preselected. The active area 50 is preferably adjustable from at least one pixel within scan zone 44 up to all pixels within scan zone 44. The pixels within the active area 50 are examined for their color value. A reduced size active area 50 permits analysis of less than all of the data contained in an entire scan zone 44, which reduces computing time. The pixel data is digitized, so that a number or group of numbers corresponds to a color value or a gray scale intensity for each pixel. The digitized pixel data may then be analyzed to determine the most frequently occurring color value, which is referred to as the "mode value". The mode value is compared to a predefined selectable range of mode values. If it falls within the predefined range, then the object is selected as a candidate for removal. It may also be specified how long the mode value needs to remain within range for the object to be selected for removal. This permits small anomaly occurrences of color or transparency on the object to be ignored. These anomalies include, for example, cracks or rips in a bottle, and dirty spots. The digitized pixel data in scan zone 44 or active area 50 may also be analyzed by methods other than mode value. One such method is to find the number of occurrences of color value within a preselected range or band width of color values. When the number of occurrences is found to reach or exceed a preselected threshold then the object being scanned is selected as a candidate for removal. Another method is to average all color values within a zone 44 or active area 50 and compare the average to a preselected value or range of values to determine if the object being scanned is a candidate for removal. Another method is to find the number of adjacent pixels having a preselected color value or being within a preselected range of color values. If the number of adjacent pixels meets a preselected criteria then the object being scanned may be a candidate for removal. Other methods of determination may also be applied.

The control software s1, s2, and s3 may also include the ejector control section. The ejector control section controls the ejector 8 to appropriately eject the object selected for removal.

The control software s1, s2, s3 preferably includes error detection functions. For example, the control software may check for air pressure at the ejection nozzle, to make sure that a pressure wave has arrived, and thus to detect broken air line, failed air valves, and so forth.

The scanner 4 could alternatively use full frame imaging. However, using line scan imaging has been observed to maximize time available for data processing.

Also, instead of just gray scale video imaging, the scanner 4 could use color imaging either alternatively or additionally. Gray scale imaging has been observed to minimize cost of production and to speed data processing. However, color imaging may be required in some cases, such as detecting subtle differences in colors.

FIG. 3 illustrates the ejector 8 on a section of the sorter. In this embodiment, a lower light source 32 is utilized. The ejector 8 includes a plurality of ejector units 33, which are preferably air jets or ejector nozzles. The ejector units 33 are selectively activated, to eject objects 38, 39 in the feedstream. One such ejector is shown in allowed application Ser. No. 07/605,993, explicitly incorporated herein by reference. In FIG. 3, the dark objects 38 are selected for ejection. As illustrated, when one of the ejector units 33 is activated, one of the objects is ejected along an ejection path b that is outside of a normal path a taken by the objects. Thus, a collector or bin may be positioned below the normal path a and another below the ejection path b. In order to selectively eject materials in the feedstream, the ejector units 33 are preferably placed linearly at the lower end of the feed slide 2.

Figure 6:
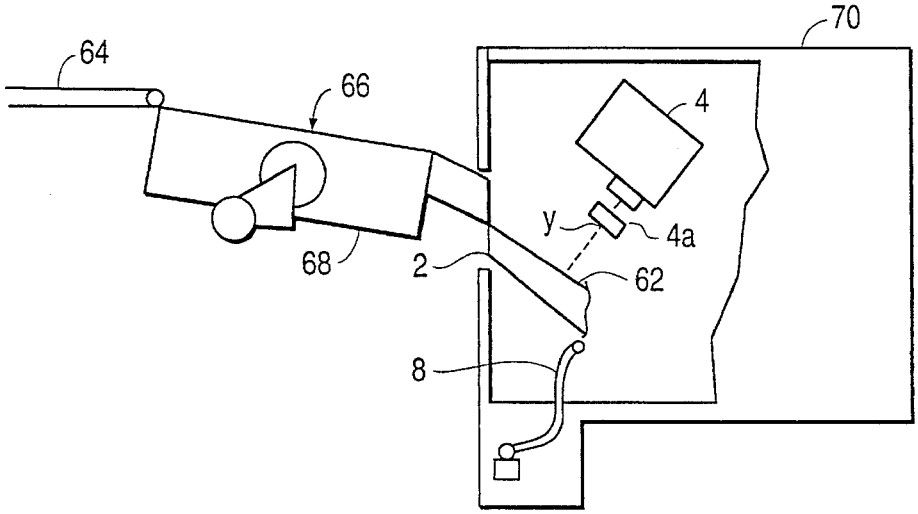
FIG. 6 is a side view of the sorter of another embodiment of the invention, integrated with a feeder.

FIG. 6 is a side view of one embodiment of the invention, illustrating one advantageous environment in which the sorter may be used. The feed slide 2 may be enclosed by side walls 62, to prevent objects in the feedstream from escaping the sorter. Also, the feedstream may be provided from a conveyor 64. The objects in the feedstream may advantageously be spread by a vibrating feeder 66, prior to being placed on the feed slide 2. The vibrating feeder 66 may be cantilevered over the feed slide 2. Additionally, the vibrating feeder 66 may be tilted at an angle, to permit the objects in the feedstream to move onto the feed slide 2. The vibrating feeder 66 may advantageously also include side walls 68. In order to minimize flying particles, provide protection for the equipment, and block out stray light which can interfere with the scanner 4, it may be preferable to enclose the feed slide 2, the scanner 4, and the ejector 8 in an enclosure 70.

Figure 7:
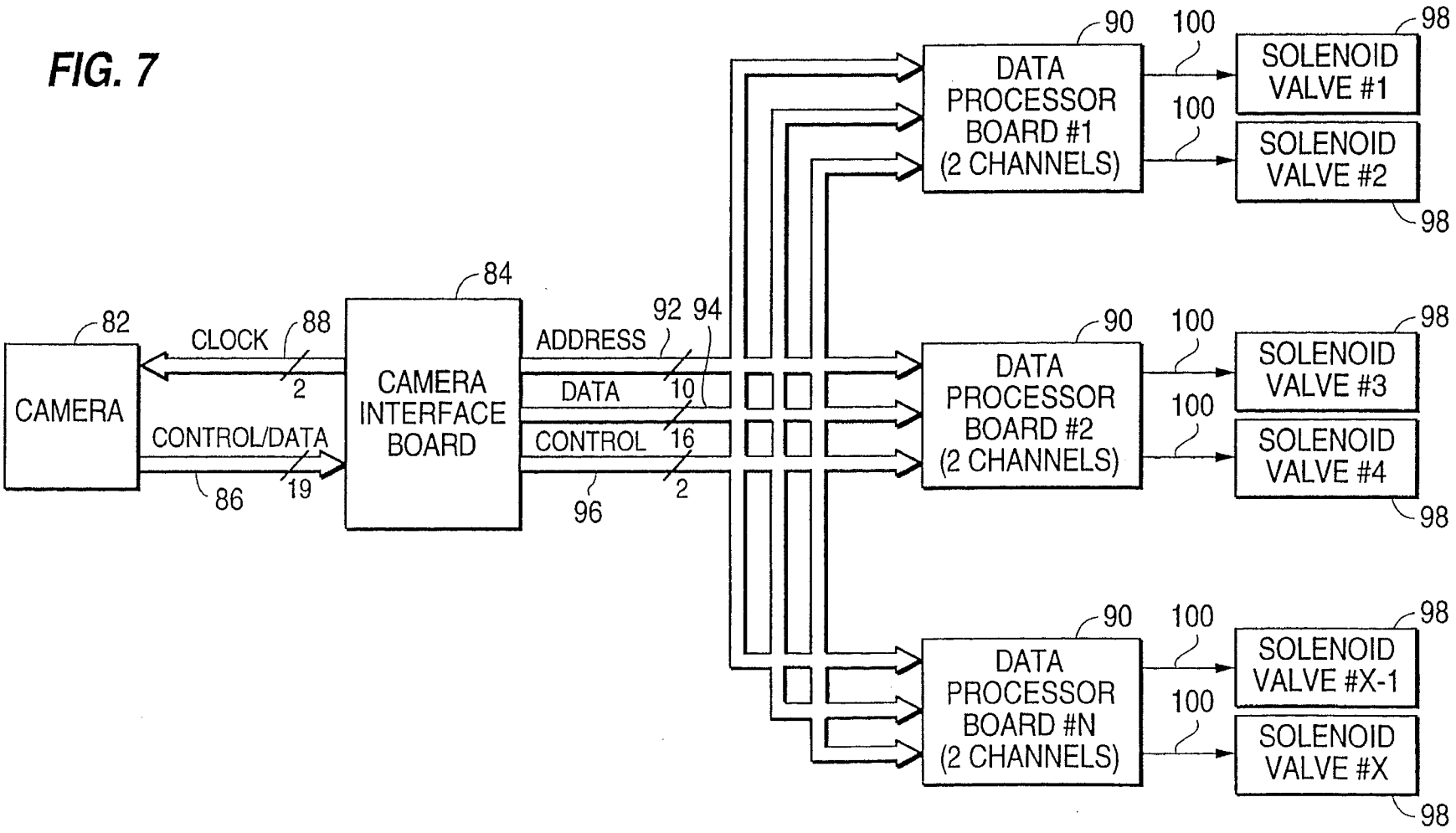
FIG. 7 is a block diagram used to illustrate relationships between certain components of the sorter, in one embodiment of the invention.

FIG. 7 is a block diagram showing how the scanner controls the ejector 8, according to one embodiment of the invention. In this embodiment, the scanner includes a camera 82, and the ejector includes a plurality of ejector units 33 (not shown in this Figure). The camera 82 is connected to a camera interface board 84 by control/data lines 86 and clock lines 88. The camera interface board 84 is connected to a plurality of N data processor boards 90 by a plurality of address, data, and control lines 92, 94, 96. The data processor boards are in turn connected to a plurality of X solenoids 98 by a plurality of control lines 100, each solenoid controlling one ejector unit. Thus, based on the data received from the camera 82, one or more of the data processor boards 90 can activate or deactivate one or more of the ejector units, and thus eject one object from the feedstream.

FIGS. 12–20 are flow charts for one embodiment of the control software, which may be run on the data processor board. In order to implement the video pixel locator logic, the color recognition and determination logic, and the ejector control logic, the control software may conveniently comprise system level software, a test section, a foreground task, a timer interrupt handler, a serial receive interrupt handler, an A/D conversion completion interrupt handler, and a FIFO buffer interrupt handler.

Figure 12:
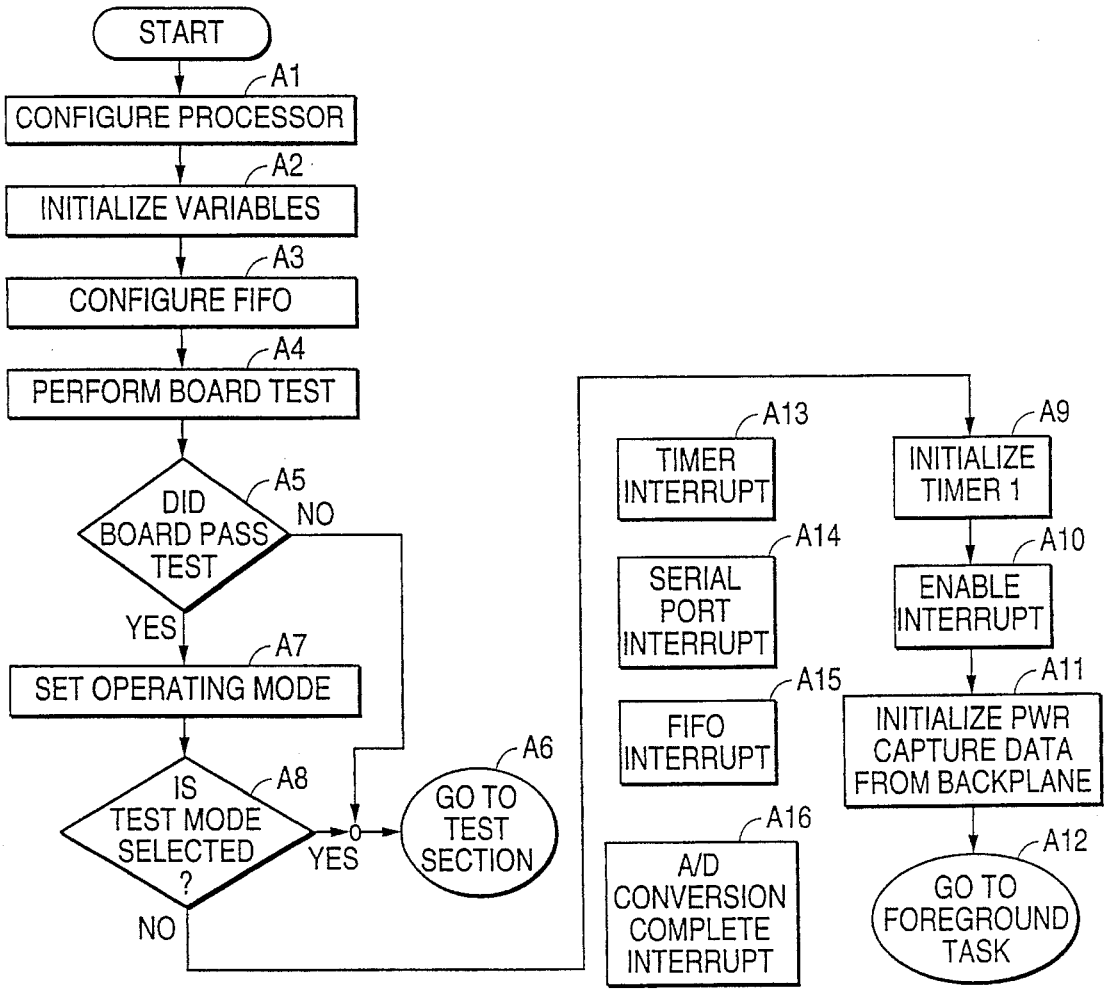
FIG. 12 is a flow chart of the initialization software for one embodiment of the system.

FIG. 12 is a flow chart of the system level software for an exemplary embodiment of the system. The system level software configures the processor A1, initializes variables A2, configures the FIFO buffer A3, and performs a board test A4. If the board did not pass the test A5, the software enters the test section A6. Otherwise, an operating mode is set A7. If a test mode is selected A8, the software enters the test section A6. Otherwise, timers are initialized A9, interrupts are enabled A10, and the board (PWA) is initialized to capture data from a backplane connected to the scanner A11. Thus, the following interrupts are initiated: timer interrupt A13, serial port interrupt A14, FIFO interrupt A15, and A/D conversion complete interrupt A16. Once initialization is complete, the software enters the foreground task section A12.

Figure 13:
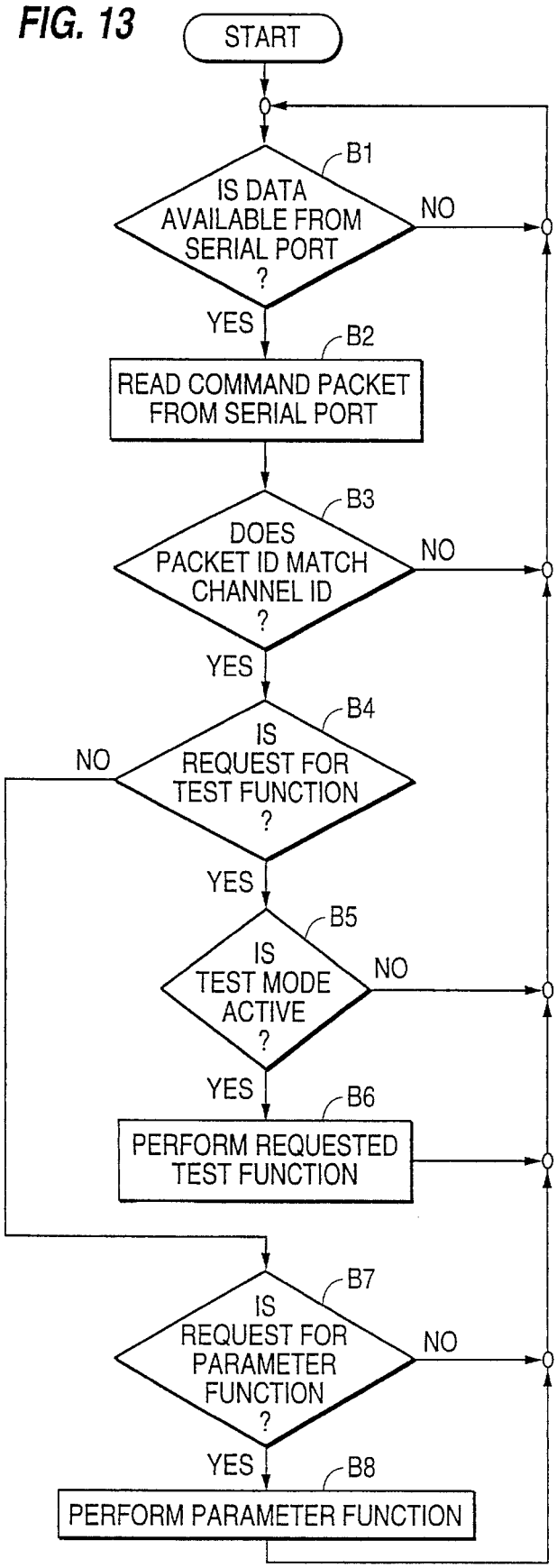
FIG. 13 is a flow chart of a test section of the software.

FIG. 13 is a flow chart of a test section A6 of the software for the embodiment in FIG. 12. The test section A6 is preferably a packet handler, which checks for data available on the serial port B1. If data is available, a command packet is read from the serial port B2. If a packet ID in the command packet does not match a channel identifier B3, that is, the packet appears to be invalid, the packet is ignored and the test section waits for more data from the serial port B1. Otherwise, if the request is for a test function B4, and if a test mode is active B5, the requested test function is performed B6. If the request is for a parameter function B7, the parameter function is performed B8. After performing a request B6, B8, the test section waits for more data from the serial port B1.

Figure 14:
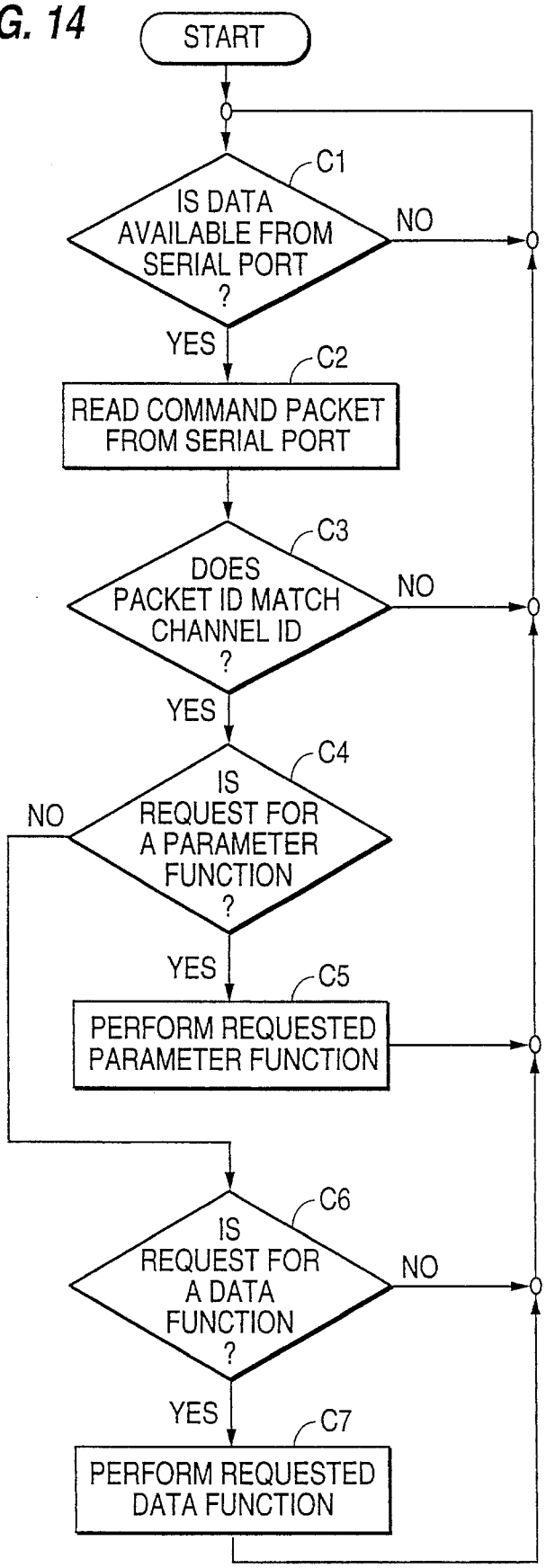
FIG. 14 is a flow chart of a foreground task of the software.

FIG. 14 is a flow chart of a foreground task A12 of the software for the embodiment in FIG. 12. The foreground task A12 is preferably a packet handler, which checks for data available on the serial port C1. It data is available, a command packet is read from the serial port C2. If a packet identifier in the command packet does not match a channel identifier C3, that is, the packet appears to be invalid, the packet is ignored and the foreground task waits for more data from the serial port C1. Otherwise, if the request is for a parameter function C4, the requested parameter function is performed C5. If the request is for a data function C6, the data function is performed C7. After performing a request C5, C7, the foreground task checks for more data from the serial port C1.

Figure 15:
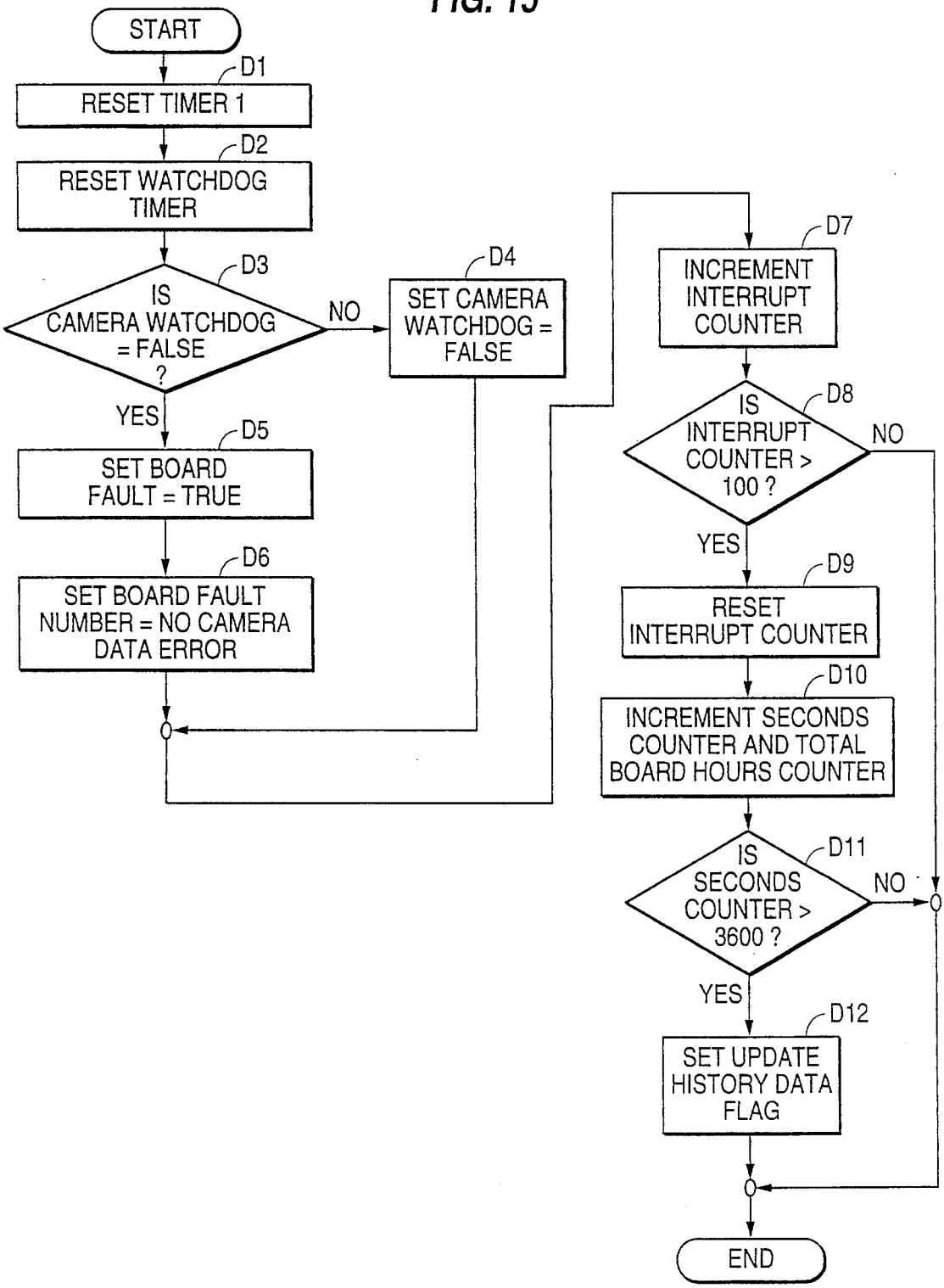
FIG. 15 is a flow chart of a timer interrupt handler for the software.

FIG. 15 is a flow chart of a timer interrupt handler for the software for the embodiment in FIG. 12. The software preferably detects the erroneous condition of no data available from the camera. This is conveniently implemented as the timer interrupt handler, preferably including a camera watchdog timer. The camera watchdog timer is conveniently implemented by being set true by the FIFO interrupt handler, which preferably executes every 1–4 mSeconds. The time interrupt handler preferably executes once every 10 Msecconds. Therefore, theoretically, the timer interrupt handler will never see the camera watchdog timer set to false unless camera data is not available via the backplane. Thus, the timer interrupt handler may reset a Timer 1 D1, and reset the camera watchdog timer D2. If the watchdog timer is false D3, a board fault is set to true D5, and a board fault number is set to indicate "no camera data error" D6. Otherwise, the camera watchdog timer D4 is set to false. Then, an interrupt counter is incremented D7. If the interrupt counter is greater than a maximum D8, preferably 100, the interrupt counter is reset D9, and the second counter and total board hours counters are incremented D10. If the seconds counter is greater than a maximum D11, such as 3,600, an update history data flag is set D12.

Figure 16:
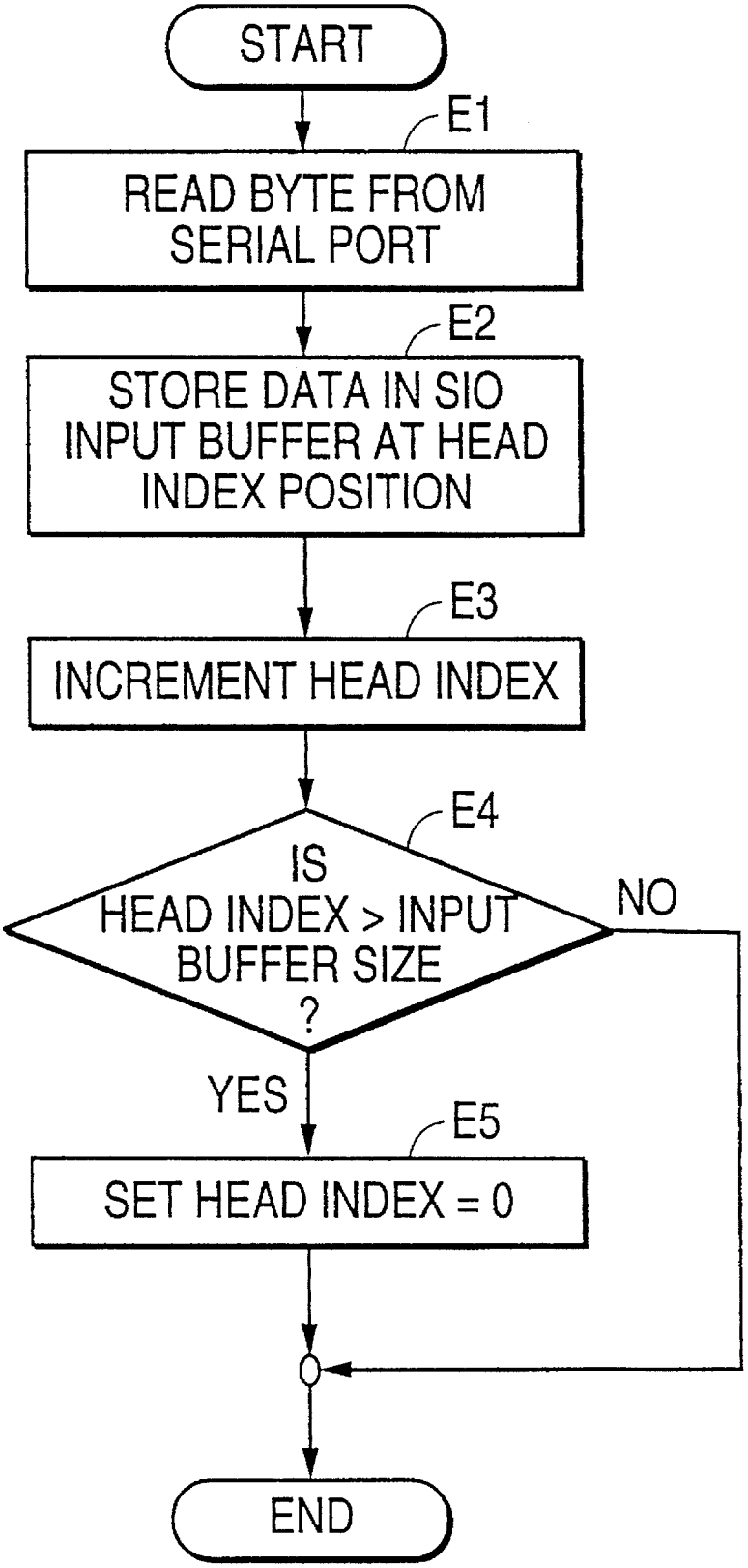
FIG. 16 is a flow chart of a serial receive interrupt handler for the software.

FIG. 16 is a flow chart of a serial receive interrupt handler for the software for the embodiment in FIG. 12. The serial receive interrupt handler preferably reads data from the serial port and stores the data in a wrap-around buffer. This is conveniently implemented as follows. The serial receive interrupt handler reads a byte from the serial port E1, stores data in a serial I/O (SIO) input buffer at a position pointed to by a head index E2, and increments the head index E3. If the head index is greater than the input buffer size E4, the head index is set to zero E5.

Figure 17:
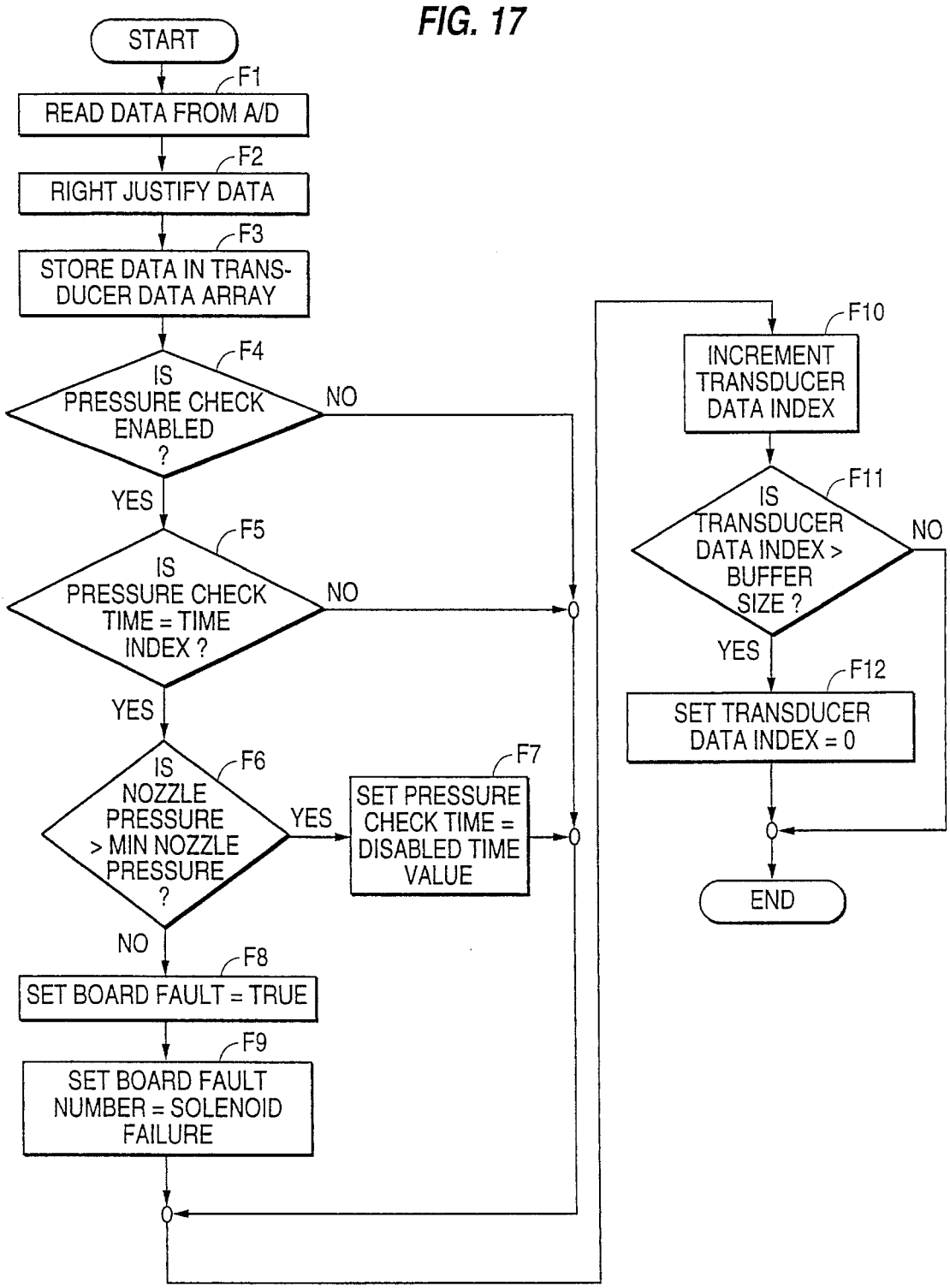
FIG. 17 is a flow chart of an A/D conversion complete interrupt handler and air pressure check subroutine for the software.

FIG. 17 is a flow chart of an A/D conversion complete interrupt handler for the software for the embodiment in FIG. 15. The A/D conversion complete interrupt handler preferably reads the A/D data from the pressure transducers and stores the data as bytes in a transducer data array. The A/D conversion complete interrupt handler also preferably handles nozzle pressure checking. This is conveniently implemented as follows. The A/D data is read F1, right justified F2, and stored in the transducer data array F3. If pressure check is enabled F4, if the pressure check time is equal to a preset time index F5, and if the nozzle pressure is greater than a specified minimum nozzle pressure F6, a set pressure check time flag is set to a disabled time value F7. If the nozzle pressure is not greater than a specified minimum nozzle pressure F6, the board fault flag is set to true F8, and the board fault number is set to indicate "solenoid failure" F9. A transducer data index is incremented F10. If the transducer data index is greater than the buffer size F11, the transducer data index is reset to zero F12, thus wrapping around the pointer into the buffer.

Figure 18A:
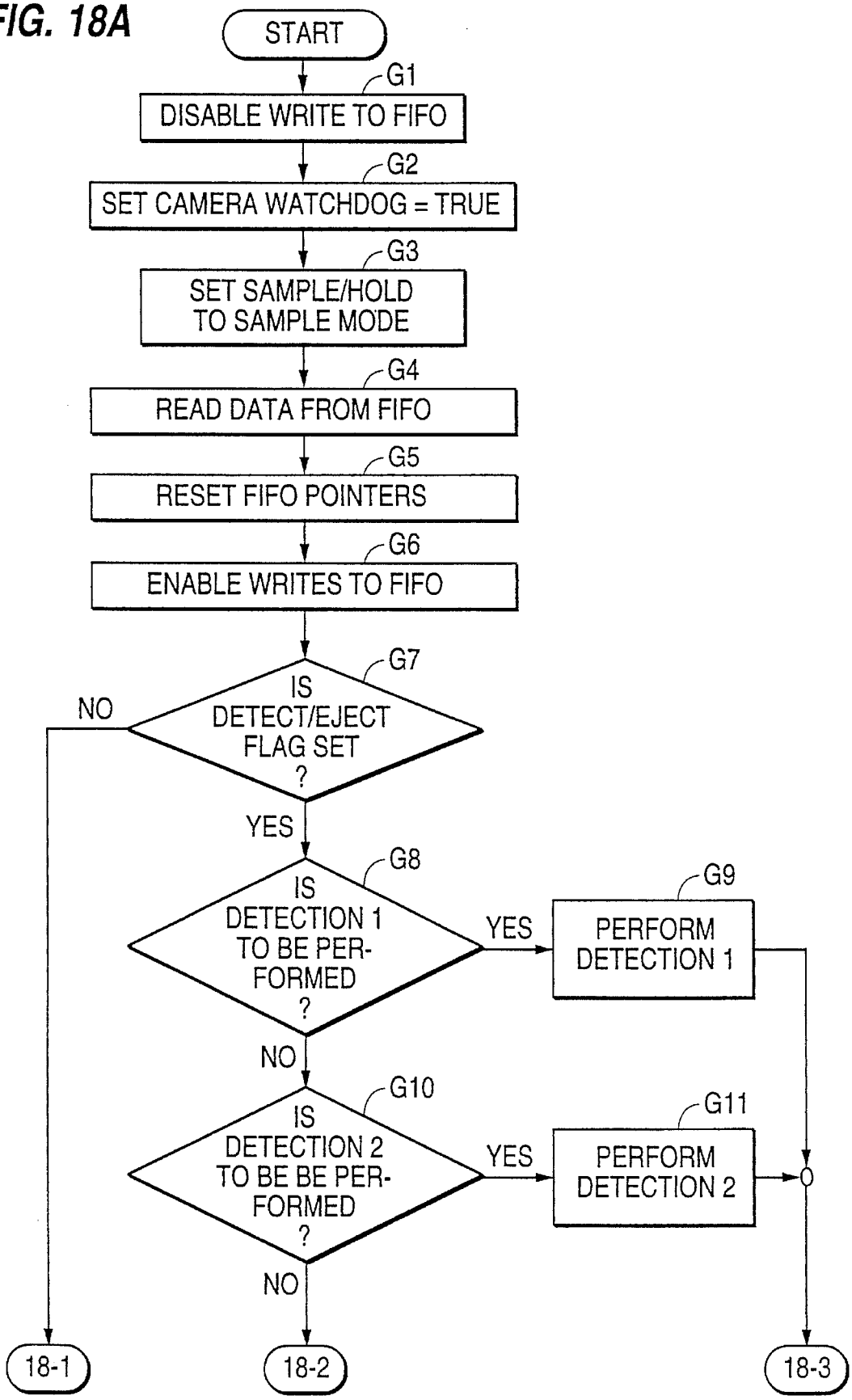
FIGS. 18A–18B are flow charts of a FIFO interrupt handler for the software.
Figure 18B:
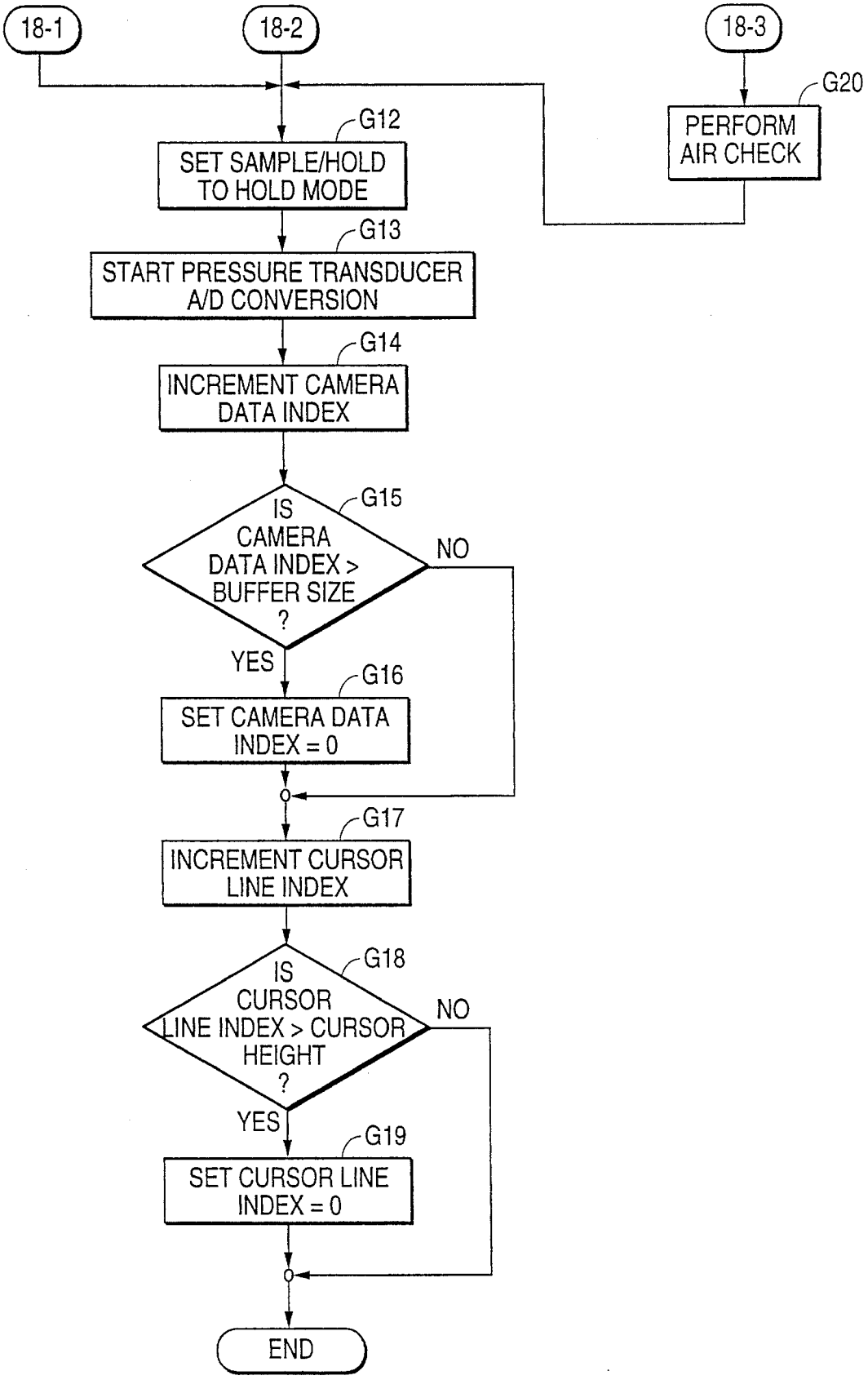
Figure 19A:
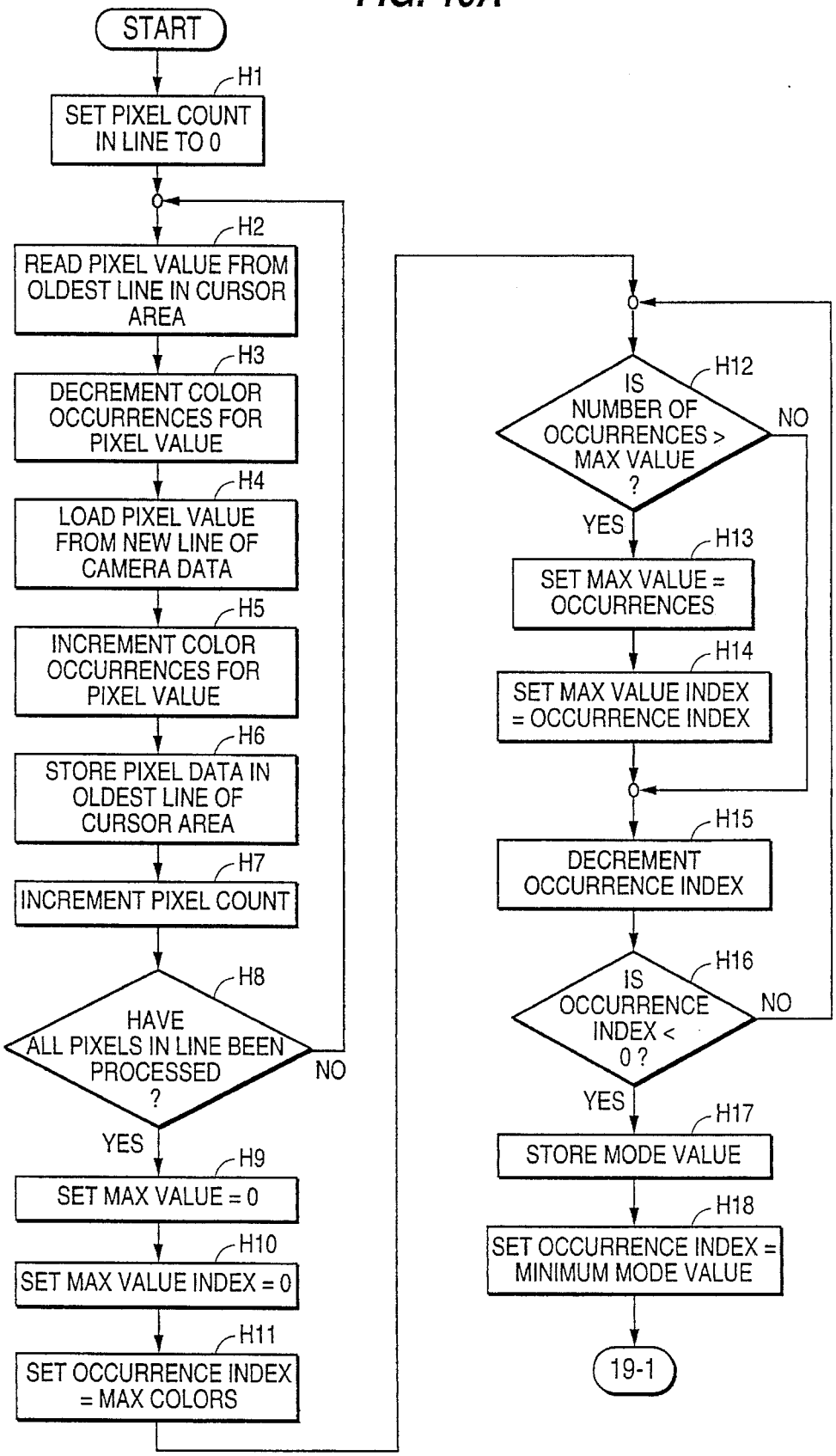
FIGS. 19A–19E are flow charts of a color detection subroutine for the software.
Figure 19B:
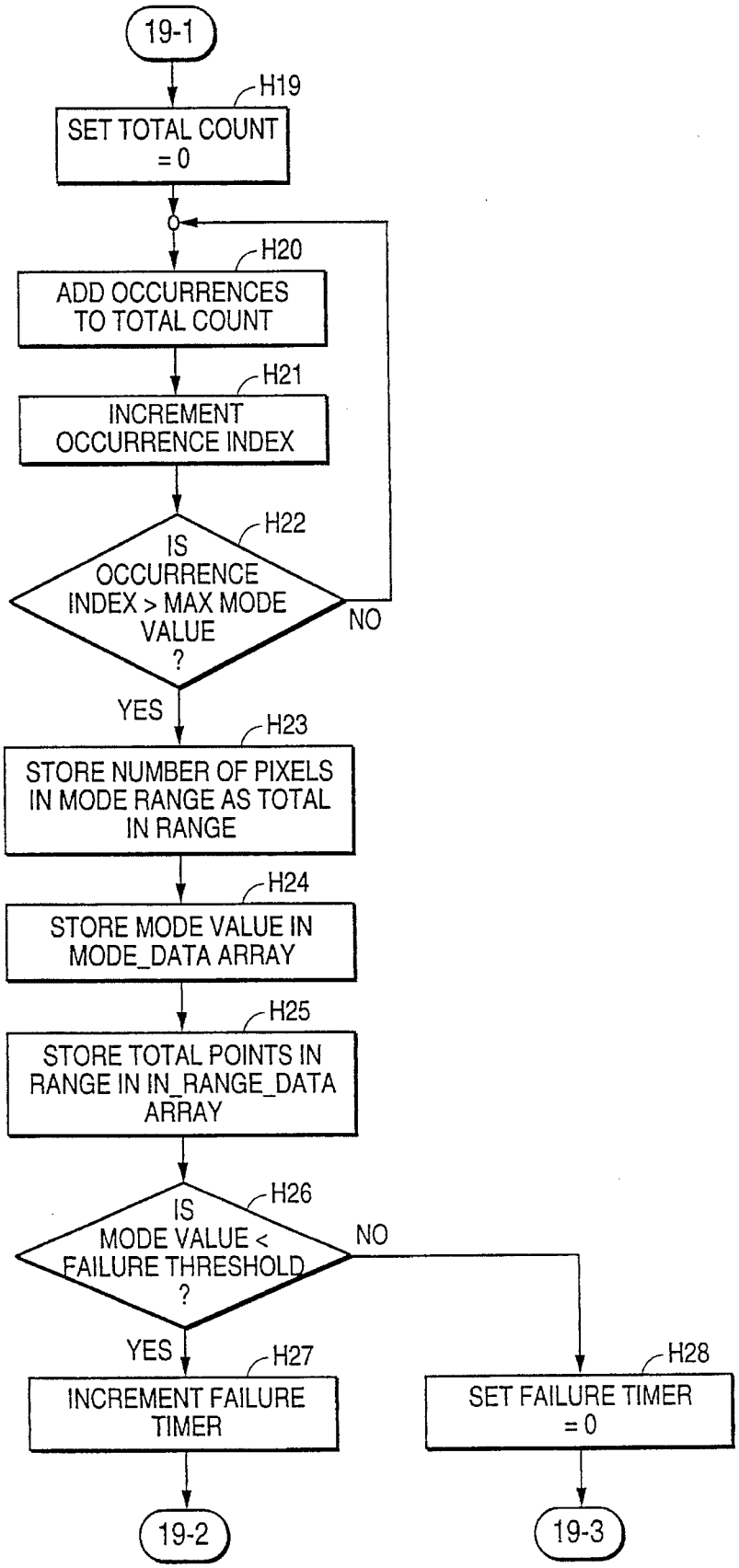
Figure 19C:
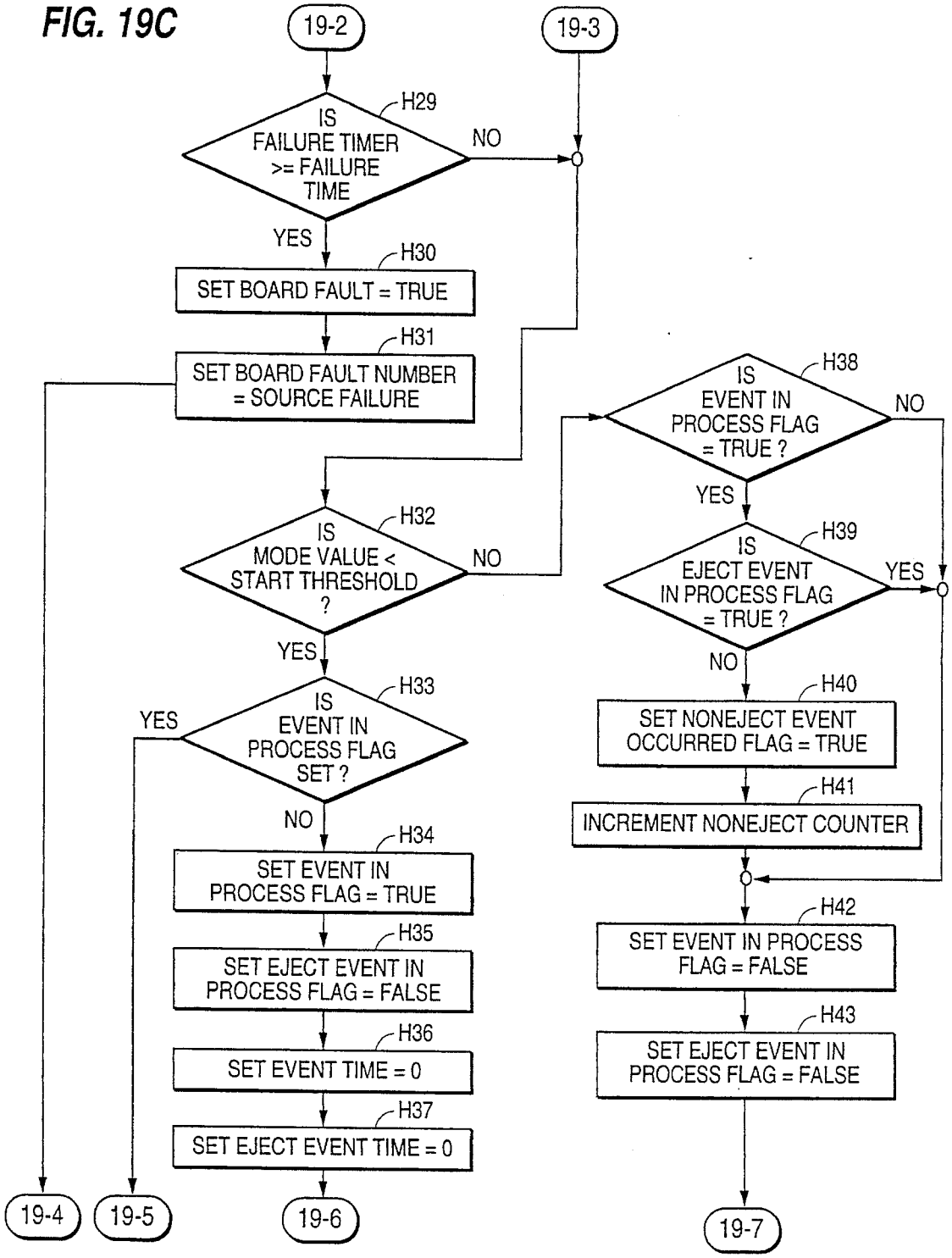
Figure 19D:
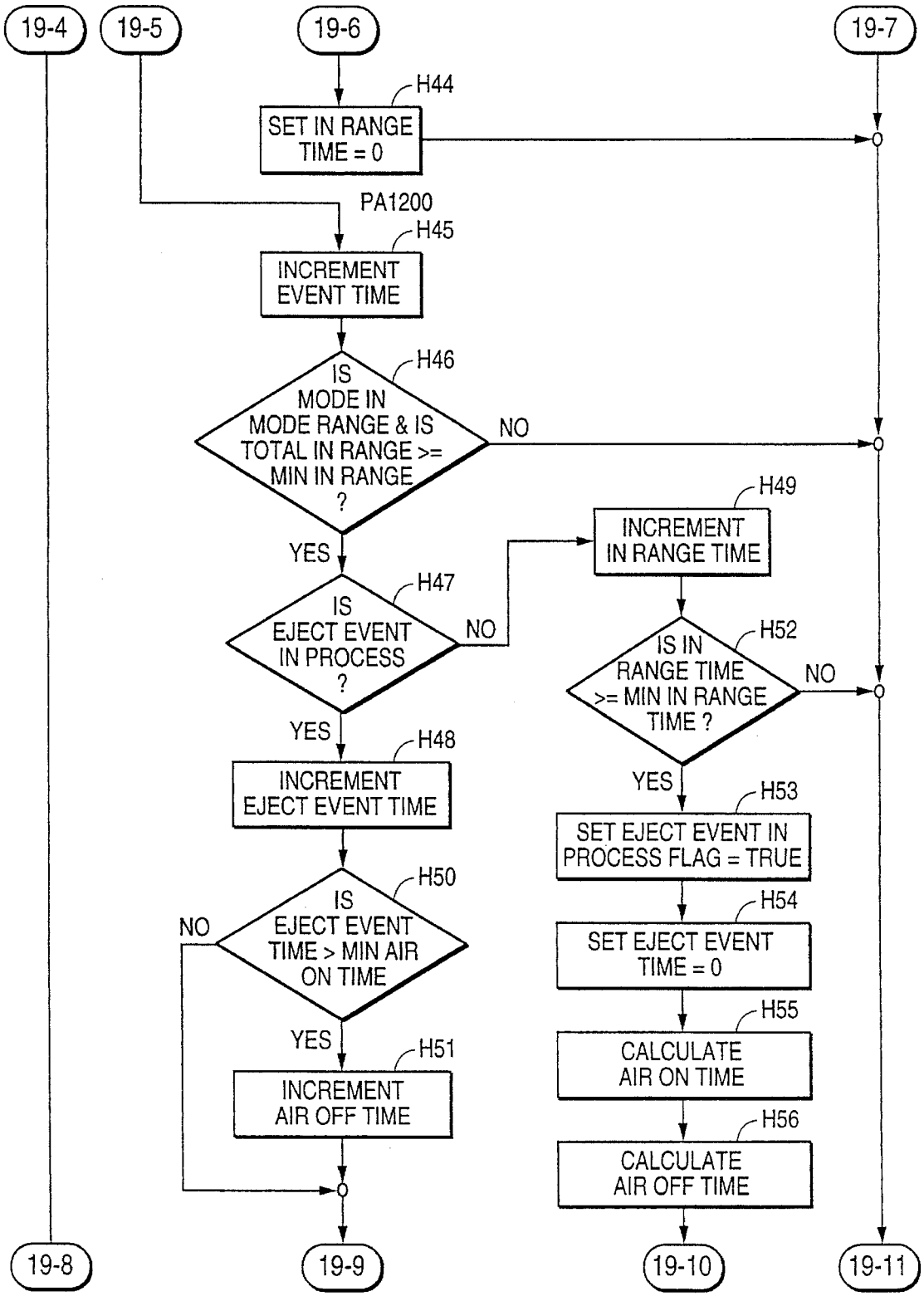
Figure 19E:
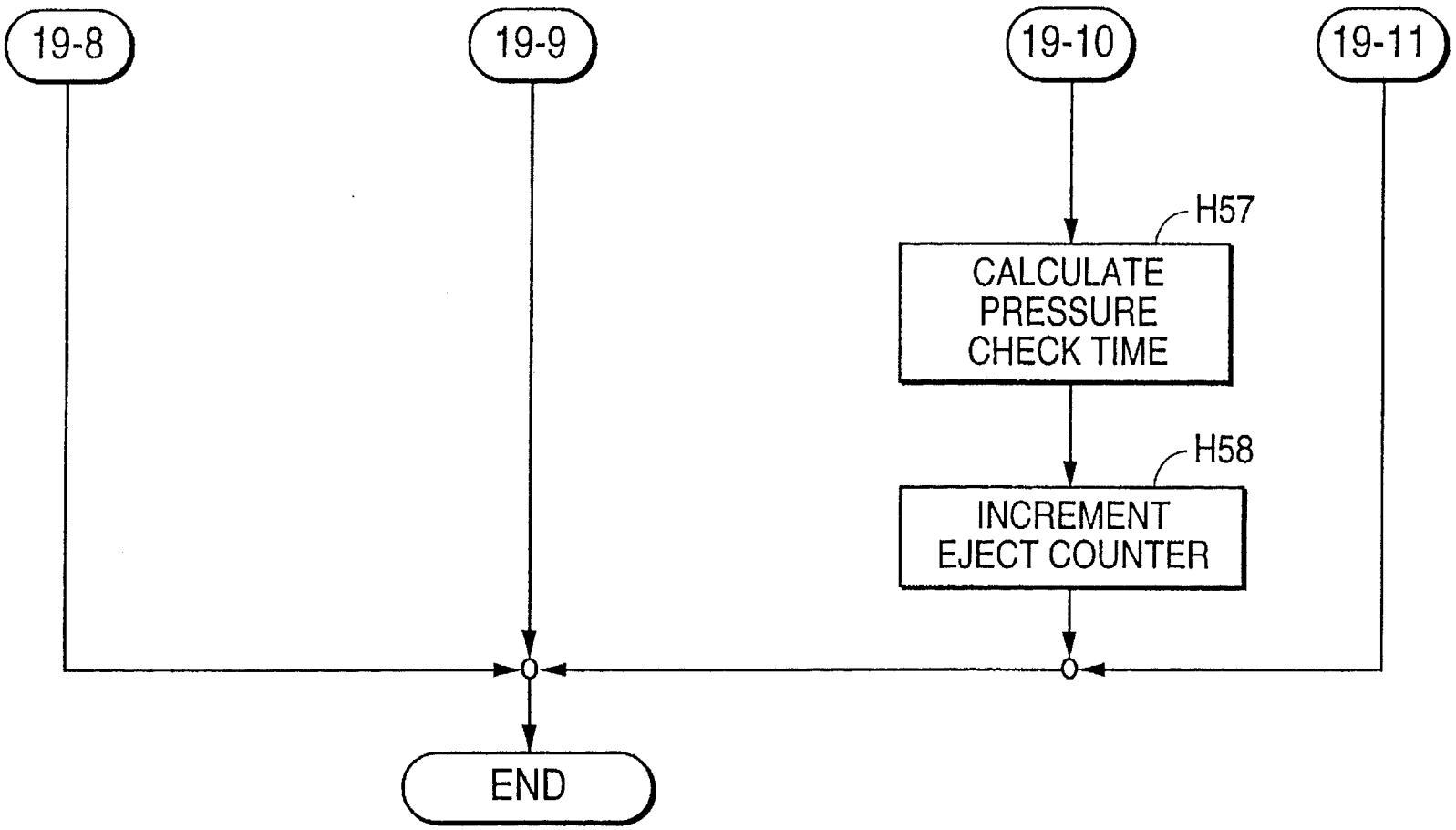

FIGS. 18A–18B are flow charts of a FIFO interrupt handler for the software for the embodiment in FIG. 12. Preferably, the FIFO interrupt handler reads data from the FIFO, resets the camera watchdog timer, calls one color detection subroutine, points to an appropriate location in a buffer holding camera data, and calls an air pressure check subroutine. This can be conveniently implemented as follows. Writes to the FIFO buffer are disabled G1, the camera watchdog timer is set to true G2, a sample/hold flag is set to "sample mode" G3, data is read from the FIFO buffer G4, FIFO pointers are reset G5, and writes to the FIFO buffer are enabled G6. Then, if a detect/eject flag is set true G7, one of several color detection subroutines is called. In the example illustrated, there are two color detection subroutines G9, G11, which are performed if indicated G8, G10. If one of the color detection subroutines is performed, an air pressure check subroutine G20 is also preferably performed. Otherwise, the buffer is treated as follows. The sample/hold flag is set to "hold mode" G12, pressure transducer A/D conversion is started G13, and a camera data index into the buffer is incremented G14. If the camera data index is greater than the buffer size G15, it is wrapped around by resetting the camera data index to zero G16. A cursor line index is incremented G17, and if the cursor line index is greater than a predetermined cursor height G18, it is reset to zero G19.

FIGS. 19A–19E are flow charts of an exemplary embodiment of the color detection subroutine for the software for the embodiment in FIG. 12. The color detection subroutine preferably updates a number of occurrences of each color in a cursor area, determines the mode value, calculates a number of pixels in the cursor area that are between minimum and maximum values, and detects the color.

Steps H1–H8 update the number of occurrences of each color in the cursor area. A pixel line count is set to zero H1. A pixel value is read from an oldest line in the cursor area H2. A number of color occurrences for the pixel value is decremented H3. The pixel value is loaded from a new line of the camera data H4. The number of color occurrences for the pixel value is incremented, the pixel data is stored in the oldest line of the cursor area H6, and the pixel count is incremented H7. Steps H2–H7 are repeated until all pixels in the line have been processed H8.

Steps H9–H17 determine the mode value. A maximum value is initialized to zero H10, and the occurrence index is set to a maximum number of colors H11. If the number of occurrences is greater than the maximum value H12, the maximum value is set to the number of occurrences H13, and the maximum value index is set to the occurrence index H14. The occurrence index is decremented H15. Steps H12 through H15 are repeated until the occurrence index is less than zero H16. Then, the mode value is stored H17.

Steps H18–H25 determine the number of pixels in the cursor area that are between the minimum and maximum mode values. The occurrence index is initialized to the minimum mode value H18, and a total count is initialized to zero H19. The number of occurrences is added to the total count H20, and the occurrence index is incremented H21, until the occurrence index is greater than the maximum mode value H22. Then, the number of pixels in the mode range is stored as the total in the range H23, the mode value is stored in a mode data array H24, and a total points in the range is stored in an In Range Data Array H25.

Steps H26–H58 determine the color. First, potential failures are checked. If the mode value is less than a determined failure threshold H26, a failure timer is incremented H27. If the failure timer is at least as large as a specified failure time H29, the board fault flag is set to true H30, and the board fault number is set to "source failure" H31.

Otherwise, if the mode value is greater than or equal to a determined failure threshold H26, the failure timer is reset to zero H28. If the mode value is lower than a specified start threshold H32, and if an event in process flag is not set H33, the event in process flag is set to true H34, an eject event in process flag is set to false H35, a set event time is set to zero, an eject event time is set to zero H37, and an in range time is set to zero H44.

Otherwise, if the mode value is not lower than a specified start threshold H32, if the event in process flag is true H38, and if the eject event in process flag is false H39, the non-eject even occurred flag is set to true H40, and the non-eject counter is incremented H41. The event in process flag is set to false H42, and the eject event in process flag is set to false H43.

Otherwise, if the event in process flag is set H33, an event time is incremented H45. If the mode is in the mode range and the total in range is greater than or equal to the minimum in range H47, then it is checked whether an eject event is in process H47. If an eject event is in process H47, the eject event time is incremented H48; if the eject event time is greater than a specified minimum air on time, then an air off time is incremented. If an eject event is not in process H47, then an in range time is incremented H49; If the in range time is greater than or equal to a minimum in range time H52, the eject event in process flag is set to true H53, the eject event time is set to zero H54, the air on time is calculated H55, the air off time is calculated H56, the pressure check time is calculated H57, and the eject counter is incremented H58.

Figure 20:
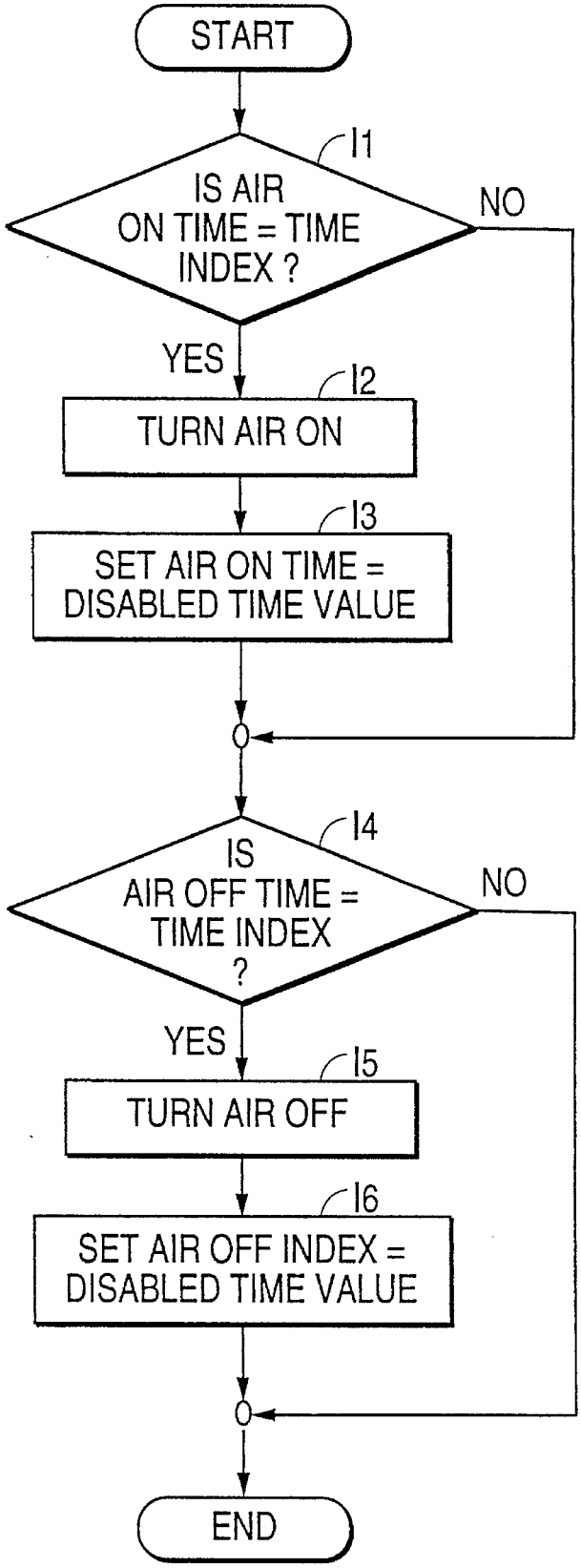
FIG. 20 is a flow chart of an ejection control subroutine for the software.

FIG. 20 is a flow chart of an air pressure check subroutine for the software for the embodiment in FIG. 12. If an air on time is equal to a time index I1, the air is turned on I2, and the air on time is set to a specified disabled time value I3. If an air off time is equal to the time index I4, the air is turned off I5, and the air off index is set to the disabled time value I6.

Variations on the above exemplary implementation are possible and are still within the scope of the invention. For example, a state table mechanism could be used instead of flags; buffers could be handled differently; and the functions or procedures could be re-grouped into different subroutines, tasks, and/or interrupt handlers. Moreover, the above-described software could be implemented in hardware or firmware, or be divided between processors, and still be within the scope of the invention.

EXAMPLES

Sorting Plastic Bottles

The majority of plastic bottles can be classified into five principal colors and polymer groups: clear PET, green PET, natural HDPE, mixed color HDPE, and polyvinyl chloride (PVC). Other known technology can be used to separate the PVC from the other four groups. Differences in optical properties between the color/polymer groups can be used to separate the remaining four.

Figure 8:
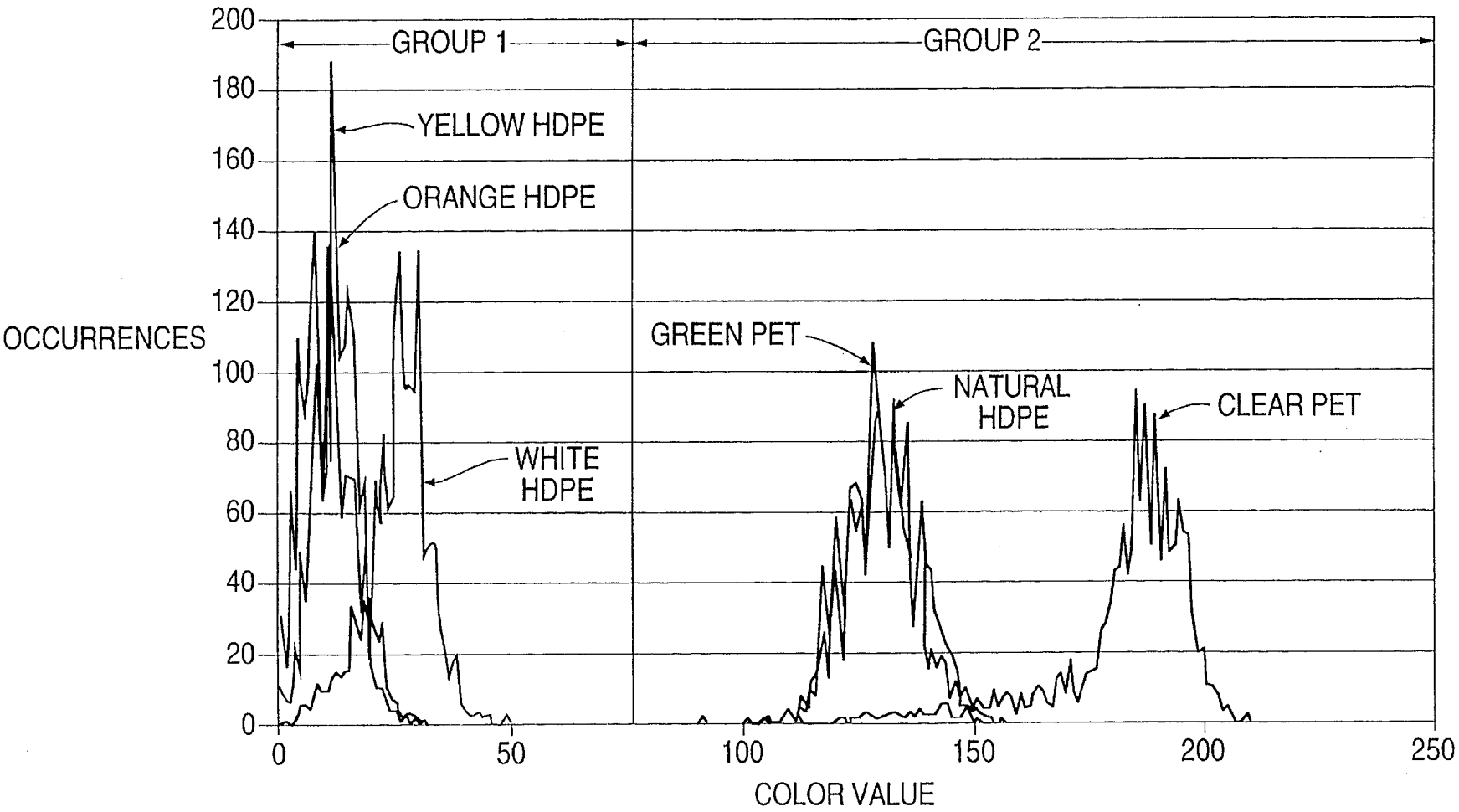
FIG. 8 is a graph used to illustrate an approach for separating clear and translucent plastics from opaque plastics.

FIG. 8 shows color value spectra for fluorescent back lighting for various plastic bottles. Labels are also included, although it is believed that they do not present a problem in determining resin type or color for whole bottles, since as long as some portion of a given bottle will not be covered by a label, there will be sufficient information available from the bottle. The graphs show that PET (transparent) and natural HDPE (translucent) have color value distributions above 100, while the opaque HDPE bottles and labels have color values below 50. A sorting sequence, analogous to that described below, can be applied, based on the spectral distributions shown in FIG. 8.

Sorting Glass Containers

Figure 9:
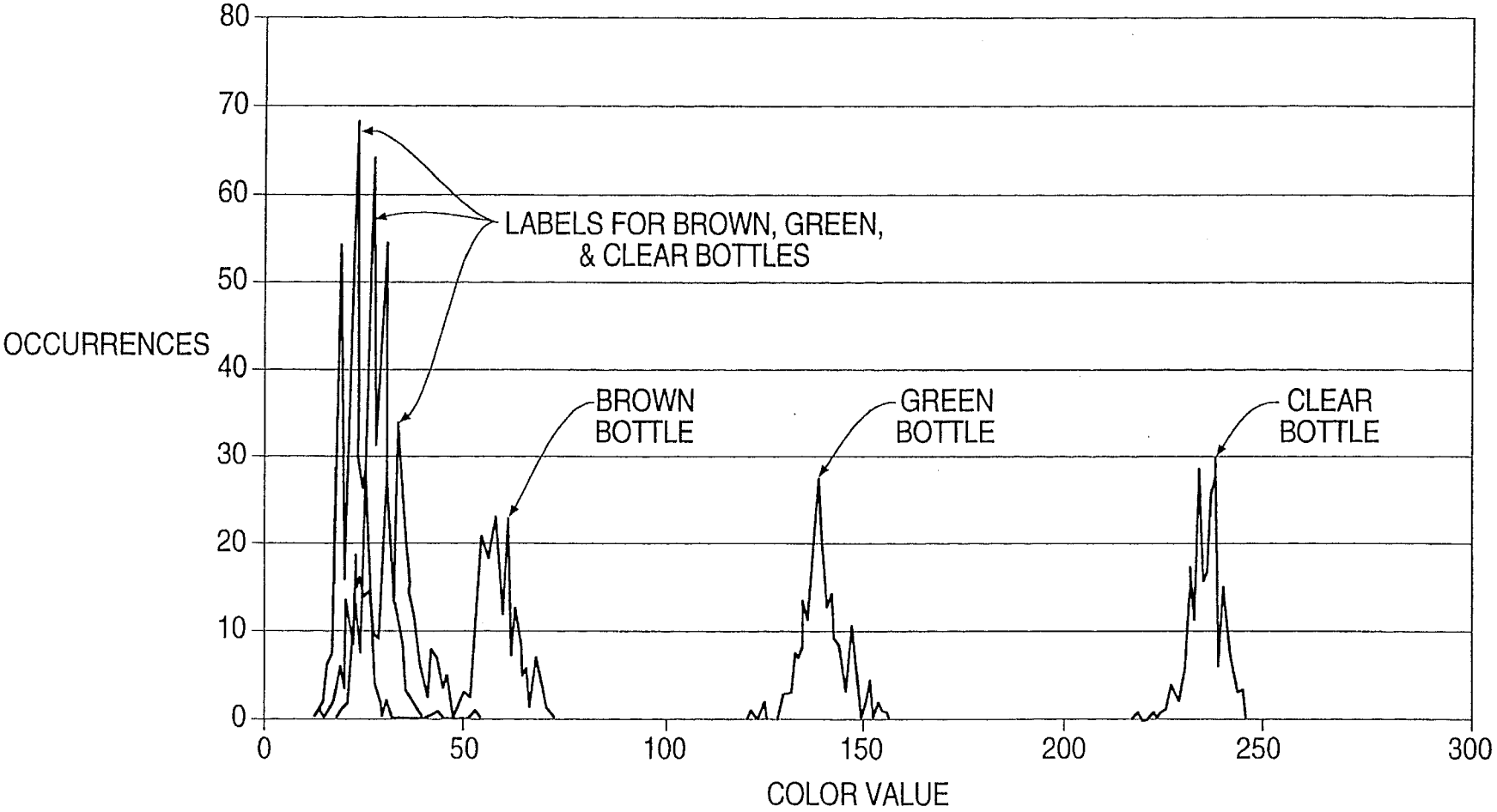
FIG. 9 is a graph used to illustrate color separation for glass bottles, and the effects of labels on glass bottles.

Post-consumer glass containers come in three predominant transparent colors: clear, green and brown. FIG. 9 shows spectral distributions for clear, green and brown bottles using fluorescent back lighting. Also illustrated is the effect of labels on the bottles. The color differences are determined by horizontal separation.

A simple sequence which can be applied to effect sorting based upon the spectral distributions shown in FIG. 9 is as follows:

1) Eject all bottles having a color value above 200 from some portion of the bottle. This will eject all clear glass bottles.
2) Eject all bottles with color values above 100 from the remaining mix of green and brown bottles. This will separate the green bottles from the brown bottles.

If any clear glass was remaining in the mixture, this will also be ejected. This is not a problem, since green glass mixed with clear glass is as marketable as pure green glass.

Therefore, with two ejections, the glass can be separated into three marketable products.

Sorting Glass Cullet

The sorting of glass cullet is potentially more challenging than the sorting of whole glass bottles, since there are many more pieces and since the label problem becomes more complex. Additionally, the broken glass pieces will have a wider size range.

Initial sorters will have a size resolution of about ½ inch, that is, ejections will occur for an area of about ¼ -square inch of feed materials. Even though the sensing technology will be able to sense and select smaller pieces, the ejection system will eject everything within a ¼ -square-inch region around a selected piece. Therefore, more selective sorters are feasible, but may not be economical at this point.

Because of this limitation, the sorting sequence for glass cullet will be one that leaves a non-ejected clear glass product since the clear glass product must have a very low level of contamination by green and brown glass. If the clear glass pieces were ejected, it is likely that a brown or green glass piece would occasionally be within the ¼ square inch ejection region. The green and brown products are not as sensitive to cross-contamination by the other colors, particularly clear glass.

Figure 10:
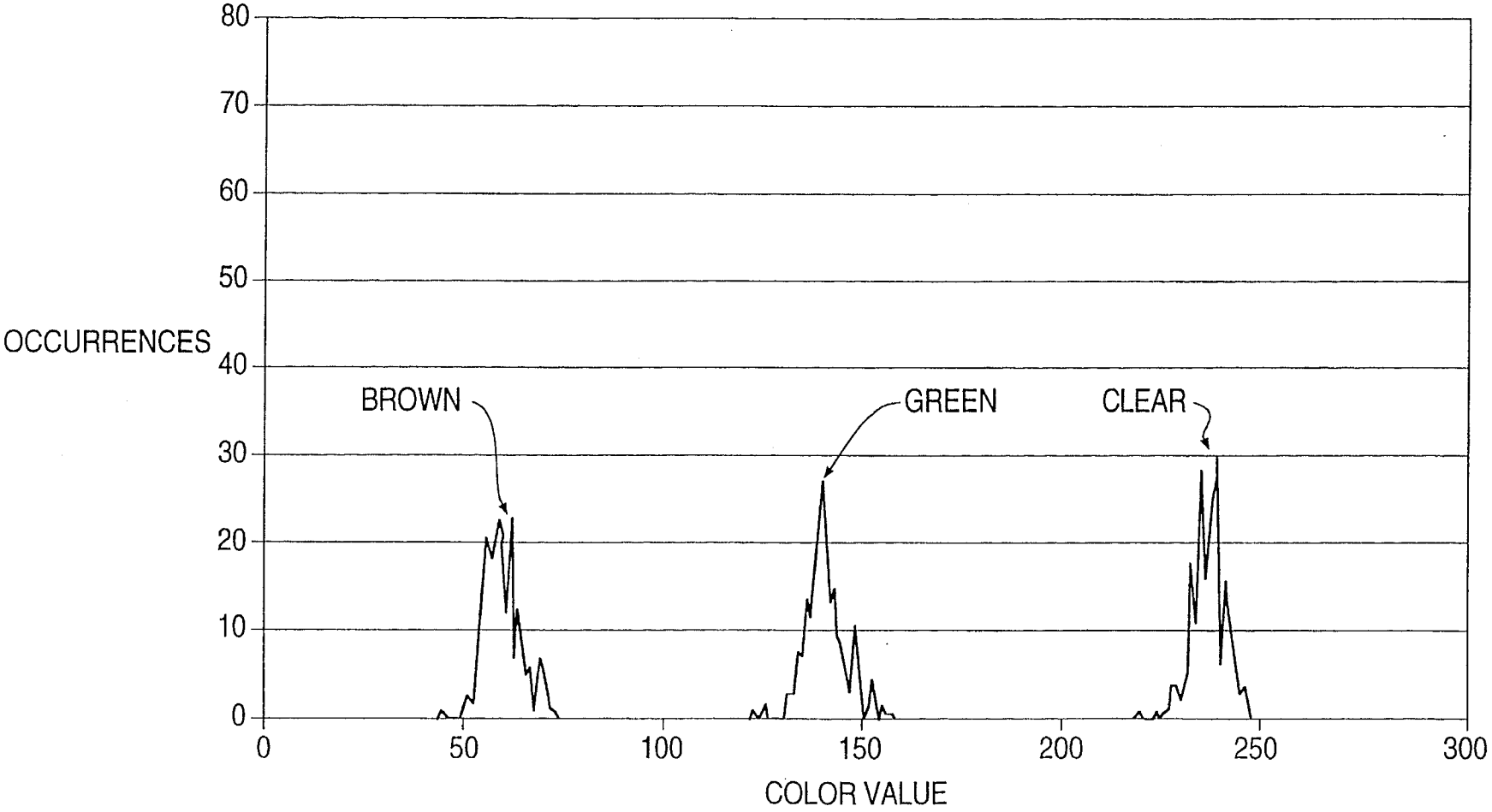
FIG. 10 is a graph used to illustrate color separation for glass cullet.

FIG. 10 shows the spectral distributions for brown, green and clear glass cullet, without labels, using fluorescent back lighting. Labels would have distributions like those for labels shown in FIG. 9. The cullet could be sorted by the following sequence:

1) Eject pieces with a color value between 100 and 200, corresponding to green glass.
2) Eject pieces with a color value below 100, corresponding to brown glass and glass covered by labels.

Light Output Tests

Table 1, below, and FIG. 11 illustrates the results of tests of light output from fluorescent strips, showing the intensity obtained at a distance from the center of the strip. The test shows that output peaks at the center of the strip, and drops off at the ends near the electrodes.

In this test, the light source was a 36 inch fluorescent light bulb and the distance from the camera to the light bulb was 40 inches.

TABLE 1

| Inches from Center | Intensity |
|---|---|
| −17 | 35 |
| −16 | 55 |
| −15 | 85 |
| −14 | 103 |
| −13 | 110 |
| −12 | 115 |
| −11 | 117 |
| −10 | 120 |
| −9 | 123 |
| −8 | 123 |
| −7 | 125 |
| −6 | 127 |
| −5 | 127 |
| −4 | 130 |
| −3 | 133 |
| −2 | 133 |
| −1 | 135 |
| 0 | 135 |
| 1 | 135 |
| 2 | 137 |
| 3 | 137 |
| 4 | 137 |
| 5 | 135 |
| 6 | 133 |
| 7 | 133 |
| 8 | 130 |
| 9 | 127 |
| 10 | 125 |
| 11 | 125 |
| 12 | 123 |
| 13 | 120 |
| 14 | 110 |
| 15 | 85 |
| 16 | 80 |
| 17 | 35 |

The results of this test is graphically illustrated in FIG. 11.

As a result of this and other similar tests, the inventors prefer a sorter using the middle 24 inches of a 36 inch fluorescent strip. It would be possible to conduct similar studies of other light sources to determine which portion of such light sources would be acceptable.

Mass Flow Test

Extensive testing of a mass flow was conducted with a sorter, the exemplary embodiment of the invention shown in FIG. 6. The sorter used for the test was rated at a throughput of 2,500 lbs/hour. A mix of various types of post-consumer plastic bottles, which had been baled, were obtained from a recycling plant. The bottles were processed through the sorter for separation into separate product fractions of colored HDPE plastics, natural HDPE plastics, clear PET plastics, and green PET plastics. A total of 908 pounds, or about 5,000 bottles, were processed.

The mass flow test consisted of three passes of an infed stream of plastic bottles through one sorter, thereby simulating a system of three sorters for producing three sorts. At the end of the test, the stream of plastic bottles was sorted into four product fractions. Tables 2–4, below, show the results of the mass flow test.

Table 2 is an analysis of the mass flow of bottles during testing, analyzing the input and output of each of the three sorts by plastic type. The first, second, and third sorts were intended to remove opaque, natural HDPE, and green PET products (respectively) from the stream. Clear PET products would then remain. A portion referred to as "positive sort" is that portion which was removed from the stream. The portion referred to as "negative sort" is that portion which remained in the stream, and was input to the next sort. Table 2 shows the minutes required to process the stream, the feed rate, and the number of bottles of each type of plastic that were positively or negatively sorted, for each of the three sorts.

TABLE 2

MASS FLOW ANALYSIS

| | ELAPSED MINUTES | FEEDRATE (Lb/Hr) | OPAQUE HDPE (Lbs) | NAT'L HDPE (Lbs) | CLEAR PET (Lbs) | GREEN PET (Lbs) | OTHER (Lbs) | TOTAL (Lbs) |
|---|---|---|---|---|---|---|---|---|
| INPUT FEED | | | 302 | 53 | 436 | 86 | 31 | 908 |
| SORT #1 | 73.6 | 741 | | | | | | |
| NEG SORT (Opaque Product) | | | 296 | 7 | 13 | 4 | 2 | 322 |
| POS SORT (INPUT TO SORT #2) | | | 6 | 46 | 423 | 82 | 29 | 586 |
| SORT #2 | 55 | 639 | | | | | | |
| NEG SORT (Nat'l HDPE Product) | | | 6 | 38 | 45 | 12 | 15 | 116 |
| POS SORT (INPUT TO SORT #3) | | | 0 | 8 | 378 | 70 | 14 | 470 |
| SORT #3 | 38 | 742 | | | | | | |
| NEG SORT (Green PET Product) | | | 0 | 3 | 17 | 69 | 4 | 93 |
| POS SORT (Clear PET Product) | | | 0 | 5 | 361 | 1 | 10 | 377 |

Table 3 is the analyses of the product fractions. It shows the weight and percent of the types of plastic bottles in each of the product fractions, after the three sorts were completed.

TABLE 3

| PRODUCT FRACTIONS ANALYSIS | OPAQUE HDPE (Lbs) | NAT'L HDPE (Lbs) | CLEAR PET (Lbs) | GREEN PET (Lbs) | OTHER (Lbs) | TOTAL (Lbs) % of Infed |
|---|---|---|---|---|---|---|
| OPAQUE PRODUCT FRACTION | 296 | 7 | 13 | 4 | 2 | 322 |
| % of Product | 91.9% | 2.2% | 4.0% | 1.2% | 0.6% | 35.5% |
| NAT'L HDPE PRODUCT FRACTION | 6 | 38 | 45 | 12 | 15 | 116 |
| % of Product | 5.2% | 32.8% | 38.8% | 10.3% | 12.9% | 12.8% |
| CLEAR PET PRODUCT FRACTION | 0 | 5 | 361 | 1 | 10 | 377 |
| % of Product | 0.0% | 1.3% | 95.8% | 0.3% | 2.7% | 41.5% |
| GREEN PET PRODUCT FRACTION | 0 | 3 | 17 | 69 | 4 | 93 |
| % of Product | 0.0% | 3.2% | 18.3% | 74.2% | 4.3% | 10.2% |
| Total Plastic Types | 302 | 53 | 436 | 86 | 31 | 908 |
| % of Infed | 33.3% | 5.8% | 48.0% | 9.5% | 3.4% | 100.0% |

Table 4 compares the efficiencies of each of the three sorts. It shows the percent by weight of the plastic bottles in the infed stream that were correctly diverted by each of the three sorts into each of the four product fractions.

TABLE 4

| INDIVIDUAL SORT EFFICIENCIES | OPAQUE HDPE (Lbs) | NAT'L HDPE (Lbs) | CLEAR PET (Lbs) | GREEN PET (Lbs) | OTHER (Lbs) | TOTALS* (Lbs) % of Infed |
|---|---|---|---|---|---|---|
| Sort #1 % Property Diverted | 98.0% | 86.8% | 97.0%: | 95.3% | N/A | 96.6% |
| Sort #2 % Property Diverted | 0.0% | 82.6% | 89.4% | 85.4% | N/A | 87.3% |
| Sort #3 % Property Diverted | N/A | N/A | 95.5% | 98.6% | N/A | 94.3% |

*Other factored out

As shown in Table 2, in the first sort (SORT #1), the bottles were processed at a feed rate of about 741 pounds per hour with the objective of the sort being to sort the opaque (colored) HDPE bottles from the other bottles. As shown in Table 4, the mixed color product contained 296 pounds of opaque bottles, or 98% of such bottles. This product also contained 26 pounds of other bottles which had been misdirected, shown in Table 3.

The second sort (SORT #2) was intended to give a natural HDPE product. Table 2 shows that 38 out of 46 pounds fed to the unit were diverted for a recovery rate of 83% of the infed. Seven pounds had earlier been lost to the opaque plastics in Sort #1. The natural HDPE product had considerable PET plastics diverted into it, indicating a need for improvement in this area.

The third sort (SORT #3) was intended to sort green PET from clear PET. Table 2 shows that the result of this sort was quite good, with only one green PET bottle mixed in with 361 clear PET bottles. This is a purity which is likely to be commercially acceptable. The inclusion of HDPE bottles in the product represents a product loss of HDPE. Nevertheless, this inclusion is not a contaminant to the PET for commercial purposes, since commercial processing lines can make this separation well for cleanup purposes. The recovery rate of 95.5% for the clear PET, shown in Table 4, was good, but can stand improvement.

It is expected that the sorter according to the invention can be improved after further experimentation to give significantly improved results. The data obtained from subsequent testing by the inventors has shown improved results over that tabulated in Tables 1–4.

While specific embodiments of the invention have been described and illustrated, it will be clear that variations in the details of the embodiments specifically illustrated and described may be made without departing from the true spirit and scope of the invention as defined in the appended claims.

What is claimed is:

1. A device for sorting refuse objects, comprising:

(a) a feed slide on which a plurality of objects are feedable, including a separation region on which a plurality of objects are placeable;

(b) a light source, cooperating with the feed slide, positioned to direct light on the separation region;

(c) an ejector including a plurality of ejector units, positioned downward of the separation region; and (d) a scanner, cooperating with the feed slide and light source, positioned to scan the separation region, determining when an object should be ejected, and controlling the ejector units; the scanner including a line scan camera and a determining unit; the determining unit including at least one processor and control software executing therein; the control software receiving input from the camera, and including video pixel locator logic, color determination and recognition logic, ejector control logic, and controlling the ejector units; the separation region including at least one scan line; a plurality of scan zones covering a portion of at least one scan line, each scan zone including a plurality of pixels; and each scan zone including at least one adjustable active area smaller than the scan zone.

2. The device of claim 1 wherein a most frequently occurring color value is determined based on the pixels, and a selection of an object as a candidate for ejection is determined based on the most frequently occurring color value and a selected range of color values.

3. The device of claim 1 wherein a frequency of occurrence of color values within a range of color values is determined based on the pixels, and a selection of an object as a candidate for ejection is determined based on a predetermined threshold value of the frequency of occurrence.

4. The device of claim 2 wherein the selection of the object is further based on a predetermined minimum length of time.

5. The device of claim 3 wherein the selection of the object is further based on a predetermined minimum length of time.

6. A method of sorting refuse objects having different color values, comprising the steps of:

(a) specifying a range corresponding to a color value of objects to be effected;

(b) passing a plurality of objects over a separation region including a scan line, the scan line including a plurality of scan zones, each scan zone including a plurality of pixels, (c) scanning the objects with a scanner;

(d) determining a color value of each object;

(e) selecting at least some of the objects for ejection which have the color value within the specified range;

(f) ejecting the selected objects into a first fraction by at least one of a plurality ejector units, thereby leaving the non-selected objects in a second fraction;

wherein the determining and selecting steps include:

(i) receiving input from the scanner;

(ii) locating video pixels;

(iii) recognizing and determining color; and (iv) activating and deactivating the ejector units, the steps of receiving input, locating video pixels, and recognizing and determining color being based on a use of the scan line, and (g) adjusting at least one adjustable active area within the scan zone.

7. The method of claim 6, including the steps of determining a most frequently occurring color value based on the pixels in the active zone, and selecting an object as a candidate for ejection based on the most frequently occurring color value and a selected range of color values.

8. The method of claim 6, including the steps of determining a frequency of occurrence of color values within a range of color values based on the pixels, and selecting an object as a candidate for ejection based on a predetermined threshold value of the frequency of occurrence.

9. The method of claim 7, wherein the selection of the object is further based on a predetermined minimum length of time.

10. The method of claim 8, wherein the selection of the object is further based on a predetermined minimum length of time.

* * * * *